US009931532B2

(12) United States Patent
Castaneda

(10) Patent No.: US 9,931,532 B2
(45) Date of Patent: Apr. 3, 2018

(54) WEIGHTLIFTING BELT AND SYSTEM

(71) Applicant: JEC Ventures, LLC, Miami, FL (US)

(72) Inventor: Javier E. Castaneda, Miami, FL (US)

(73) Assignee: JEC Ventures, LLC, Miami, FL (US)

( * ) Notice: Subject to any disclaimer, the term of this patent is extended or adjusted under 35 U.S.C. 154(b) by 0 days.

(21) Appl. No.: 15/155,688

(22) Filed: May 16, 2016

(65) Prior Publication Data

US 2017/0326403 A1 Nov. 16, 2017

(51) Int. Cl.
*A63B 21/065* (2006.01)
*A63B 23/02* (2006.01)
*A63B 21/08* (2006.01)

(52) U.S. Cl.
CPC ..... *A63B 21/065* (2013.01); *A63B 21/08* (2013.01); *A63B 23/02* (2013.01)

(58) Field of Classification Search
CPC ..... A63B 21/065; A63B 21/08; A63B 23/02; A41F 9/002; A41F 9/025
USPC ..... 2/338, 339
See application file for complete search history.

(56) References Cited

U.S. PATENT DOCUMENTS 3,659,843 A 5/1972 Kojigian, Jr.
3,751,031 A * 8/1973 Yamauchi ..... A63B 21/065 273/DIG. 19
4,984,786 A 1/1991 Lemke et al.
5,588,940 A * 12/1996 Price ..... A63B 21/4005 224/259
6,039,677 A 3/2000 Spletzer
7,081,071 B2 7/2006 Smith
7,520,844 B1 4/2009 Flynn
8,961,375 B2 2/2015 Henesey
9,573,016 B2 * 2/2017 Haddad ..... A63B 21/4043
9,630,044 B2 * 4/2017 Nelson ..... A63B 21/065
2005/0065000 A1 3/2005 Reinhart
2007/0287609 A1 12/2007 McBride
2010/0062911 A1 3/2010 Stone et al.

FOREIGN PATENT DOCUMENTS

GB 2175511 A 12/1986

OTHER PUBLICATIONS

Grizzly Nylon Dipping belt, Power Systems, downloaded May 19, 2016, available at http://www.power-systems.com/p-5006-grizzly-nylon-dipping-belt.aspx?varid=10491 &gclid=CMegpJD98MwCFQFkhgodZWUOHA.
Super Squats Hip-Belt available at IronMind e-store, Dec. 9, 2009.

* cited by examiner

*Primary Examiner* — Loan H Thanh
*Assistant Examiner* — Megan Anderson
(74) *Attorney, Agent, or Firm* — Gordon & Jacobson, P.C.

(57) ABSTRACT

A weightlifting belt includes a band of padding configured to be banded about a waist of a user and a continuous chain extending in spaced relation to the padding. The chain is coupled to the band of padding at a plurality of spaced locations along the padding. The chain is fixed to the padding at at least one of the plurality of locations and is moveably coupled to the padding at at least one of the spaced locations. In one embodiment, the center of the chain is fixed to the center of the band of padding. Also, the chain may be configured to extend about an outer surface of the padding when the padding and the chain are banded about the waist of the user. The chain may be radially spaced with respect to the outer surface of the padding.

27 Claims, 21 Drawing Sheets

WEIGHTLIFTING BELT AND SYSTEM

BACKGROUND

1. Field

The present invention relates to weightlifting equipment. More specifically, the invention relates to a weightlifting belt and a system for lifting weights.

2. State of the Art

Exercises that utilize a user's own body weight as the source of resistance can be effective weight training exercises. Exemplary exercises include squats, pull-ups, chin-ups, and dips. These and other similar exercises are often performed without machines or weights. The body weight of the user serves as the only source of resistance.

After the user has performed these body weight exercises for an extended period of time, the user's body weight becomes inadequate to fully train the target muscles. In essence, the muscles respond to the shock of training by growing. For further growth, the user must either increase the number of repetitions or sets performed, or must increase the weight.

Many trainers realize the benefits as well as the limitations associated with body weight resistance exercises. Several prior art attempts have provided ways to allow trainers to overcome the limits of their own body weight by using weightlifting equipment. For example, some devices have been designed to accomplish the task of increasing resistance by suspending extra weight from the upper body. However, this approach can be dangerous because it raises the center of gravity, creating problems with balance. Also, when weight is suspended by the shoulders or arms, the weight is transferred to the legs through the back of the person. For instance, in the past, squat exercises have been performed by a person balancing a weight on his or her shoulders behind the neck, and thereafter squatting while supporting the weight in this manner. This presents numerous drawbacks, most notably if the person has injured his or her back, or does not have sufficient back strength to support enough weight necessary to properly exercise the muscles stressed by squat exercises.

SUMMARY

A weightlifting belt includes a band of padding that is configured to be banded about a waist of a user and a continuous chain extending about and in spaced relation to the padding. The chain is coupled to the band of padding at a plurality of spaced locations along the padding. The chain is fixed to the padding at at least one of the plurality of locations and is moveably coupled to the padding at at least one of the spaced locations. In one embodiment, the center of the chain is fixed to the center of the band of padding. Also, the chain may be configured to extend about an outer surface of the padding when the padding and the chain are banded about the waist of the user. The chain may be radially spaced with respect to the outer surface of the padding. The chain may be coupled to the padding with a plurality of fasteners that are spaced along a length of the belt. The fasteners may be bolts that extend through the chain. The padding may be formed of rubber. The weightlifting belt may include a coupler for coupling ends of the chain together to band the belt about the waist of the user. The chain may include a plurality of links in which the fasteners extends through corresponding links, and at least one of the links is free to rotate and translate with respect to the fastener. The chain includes a coupler that couples the two ends of the chain and supports a weight holder. The weightlifting belt may, in conjunction with one or more weight holders, comprise a weightlifting system configured for lifting weights.

One weight holder includes a tube that is sized to stably accept weight plates having a center hole. The holder includes a lower flange larger than the center hole and fixed to the lower end of the tube on which to support the weights. The holder further includes a spring catch coupled within the upper end of the tube. The spring catch includes a hook and spring-loaded gate, each of which are in contact with a diametrically opposite side of the tube wall, and adapted to rotate toward the center of the tube from the tube wall. The weight holder is easily attached to the weightlifting belt by moving the coupler of the belt against the gate and toward the center of the tube to displace the gate against bias and enter the hook portion, wherein the gate is then released. The weight holder is then easily removed from the belt by moving the coupler of the belt against the hook to displace the hook relative to the gate. The gate is fixed in this direction by the tube sidewall, and the hook displaces to provide an opening through which the coupler can be removed.

Another weight holder may include an upper hook and a lower hook joined to the upper hook, and hooks may be wireform. The upper hook may be configured to connect to the coupler of the belt and the lower hook may be configured to pass through at least one weight plate. The upper hook and the lower hook may be oriented perpendicular to each other. The lower hook may have a generally horizontal segment for supporting weight plates substantially in a vertical orientation.

Another weight holder may include a second chain configured to extend through an opening in a weight plate and to attach to the first chain of the belt. The system may include a coupler for coupling ends of the second chain of the weight holder to ends of the first chain of the belt.

A further weight holder may include a plurality of spaced posts extending from a common base. The holder may have three posts, spaced equidistant. A center one of the posts has a connector attached to an upper end thereof for connecting the holder to the coupler of the chain of the belt. Each of the posts is configured to extend through an opening in a weight plate.

DETAILED DESCRIPTION

Figure 1:
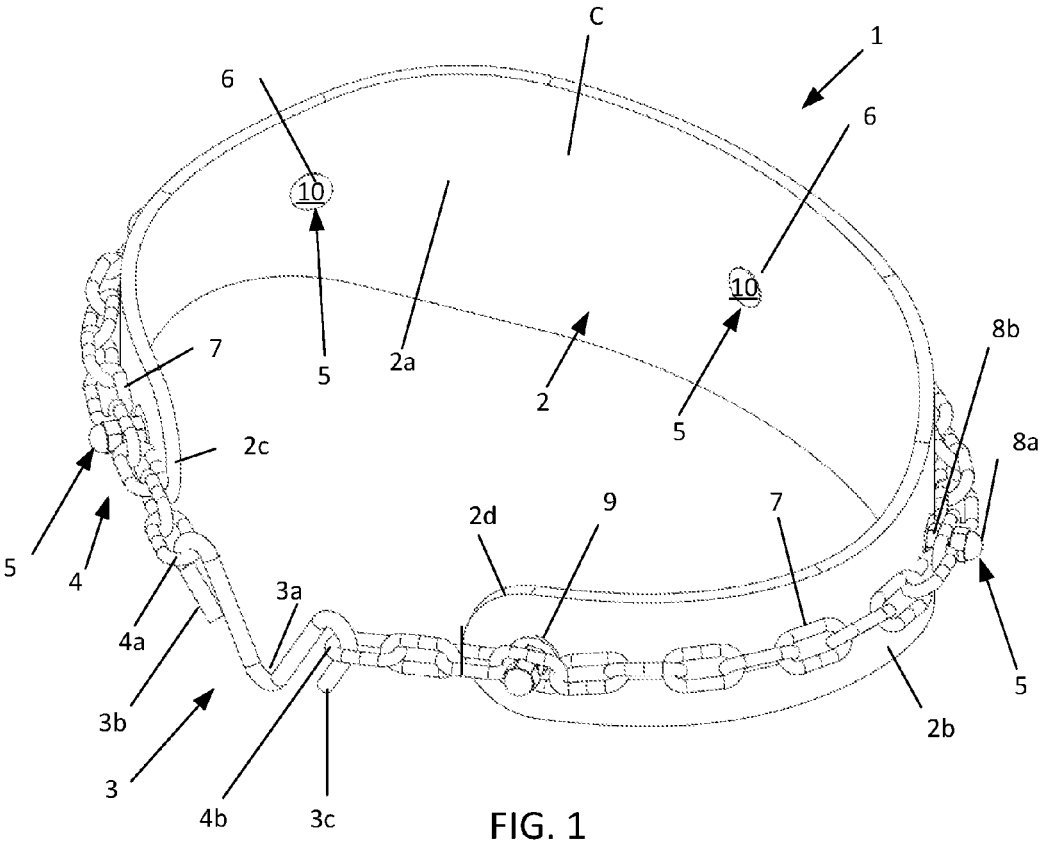
FIG. 1 is an illustration of a weightlifting belt in accordance with an aspect of the present invention.
Figure 2:
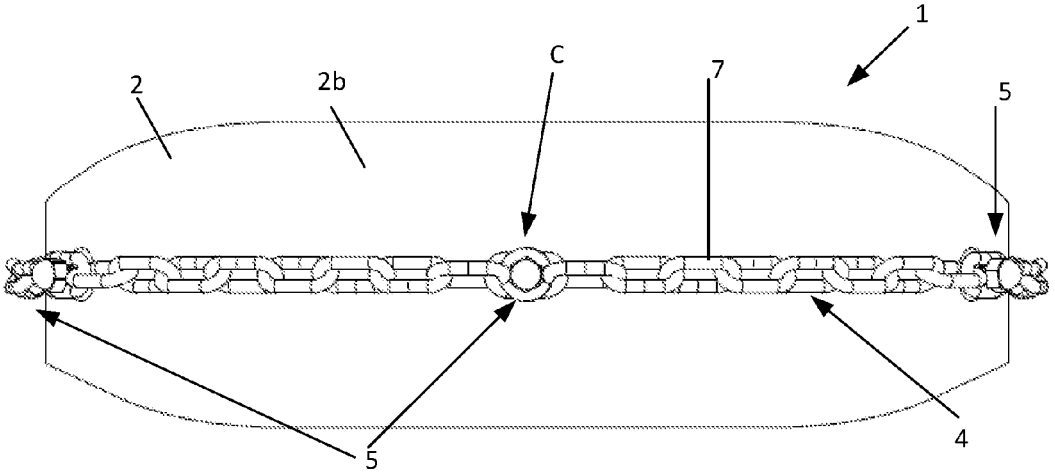
FIG. 2 is a rear view of the weightlifting belt of FIG. 1.

A weightlifting system as described herein includes a weightlifting belt and one or more attachments (holders) for supporting weights relative to the belt. FIGS. 1 and 2 illustrate the weightlifting belt 1 in accord with an embodiment of the present invention. FIGS. 3A to 13, describe various weight holder attachments 300, 300', 60, 60', 110, and 700 for supporting, relative to the belt, one or more weights, such as disc-shaped weight plates that each have a center hole, which are well known.

Referring to FIGS. 1 and 2, the belt 1 includes a band of padding 2 and a metal link chain 4 extending along the padding 2 when the padding 2 is curved into a banded configuration, as shown in FIGS. 1 to 4. The padding 2 has a first side 2*a*, which forms the inner side of the belt 1 when the belt 1 is in the banded configuration about a user. The padding 2 also has a second side 2*b*, which forms part of the outer side of the belt 1 when the belt 1 is in the banded configuration. In one embodiment, the padding 2 is formed of a compressible material, such as rubber, and is about 0.25 inch thick between its first side 2*a* and its second side 2*b*. In a preferred embodiment, the padding is double layered with a softer rubber at the first side 2*a* and a harder rubber at the second side 2*b*. The padding is wider at a longitudinal midpoint C between ends 2*c* and 2*d* for placement and support against the back of a wearer.

The chain 11 is disposed along the second side 2*b* of the padding 2 and is coupled to the padding 2 at a plurality of spaced locations 5 along the padding 2. In the embodiment shown in FIGS. 1 and 2, a center link of the chain 4 may be rigidly affixed to the padding 2 at a longitudinal midpoint between ends 2*c*, 2*d* of the padding 2. At other longitudinal locations 5 along the length of the padding 2 (i.e., not at the center of the padding 2), the chain 4 is coupled to the padding 2 with bolts 6 through individual links 7 of the chain 4 so that those individual links 7 are free to move rotationally and longitudinally side to side about the bolts 6. There are preferably five equally spaced bolt that retain all of the links. The combination of fixed and movable coupling between the links 7 of the chain 4 and the padding 2 provides load isolation between the chain 4 and the padding 2 and more even distribution of weight supported by the chain 4 about the waist of the user during weightlifting exercises.

In the embodiment shown in FIGS. 1 and 2, the chain 4 is coupled to the padding 2 with carriage bolts 6 and nuts 8*a* and 8*b*. On the second, outer side 2*b* of the padding 2, the chain 4 is radially spaced from the outer side 2*b* with threaded nuts 8*a* and/or washers 9. On the inner side 2*a* of the padding, a head 10 of each carriage bolt 6 is sunk (so as to give the appearance of being countersunk) into the first, inner side 2*a* of the padding 2. The head 10 of each carriage bolt is countersunk by tightening nut 8*a* against washer 9 on the outer side of the padding, sandwiching the padding. The countersunk carriage bolt heads 10 may limit contact with a wearer of the belt 1 when the belt is banded about the waist of the wearer, thereby limiting discomfort for the wearer. To give the appearance of being countersunk, the head 10 of each carriage bolt 6 may be compressed against the inner side 2*a* of the padding 2 by tightening a nut 8*a* located on the second, outer side 2*b* of the padding 2. As shown in FIG. 1, ends 4*a*, 4*b* of the chain 4 may extend beyond ends 2*c*, 2*d* of the padding 2 a certain amount. Cap nuts 8*b* thread onto the ends of the carriage bolts 6 to retain the links 7 between the cap nuts 8*b* and the nuts 8*a*. The cap nuts 8*b* are configured to bottom out on the ends of the carriage bolts 6 while leaving clearance space so that the links 7 are not radially compressed between the nuts 8*a* and 8*b*.

The ends 4*a*, 4*b* of the chain 4 may be connected together with the coupler 3. In one embodiment shown in FIG. 1, the coupler 3 is a triangular buckle, which includes a central 'V' 3*a* and hook ends 3*b*, 3*c* removably linked to the 4 chain. Alternatively, in another embodiment, the coupler 3 may be a clip having a metal loop with a spring-loaded gate that can link ends 4*a*, 4*b* of the chain 4 and a weight holding attachments, further details of which are described herein. The links 7 of the chain 4 may have a ninety-degree twist. The ninety-degree twist of the chain links 7 facilitates coupling the coupler 3 to the chain 4 at various positions along the length of the chain 4 (i.e., other than at the ends 4*a*, 4*b* of the chain 4) to increase or reduce the effective girth of the belt 1 without twisting the ends of the chain 4 one way or the other.

Figure 3A:
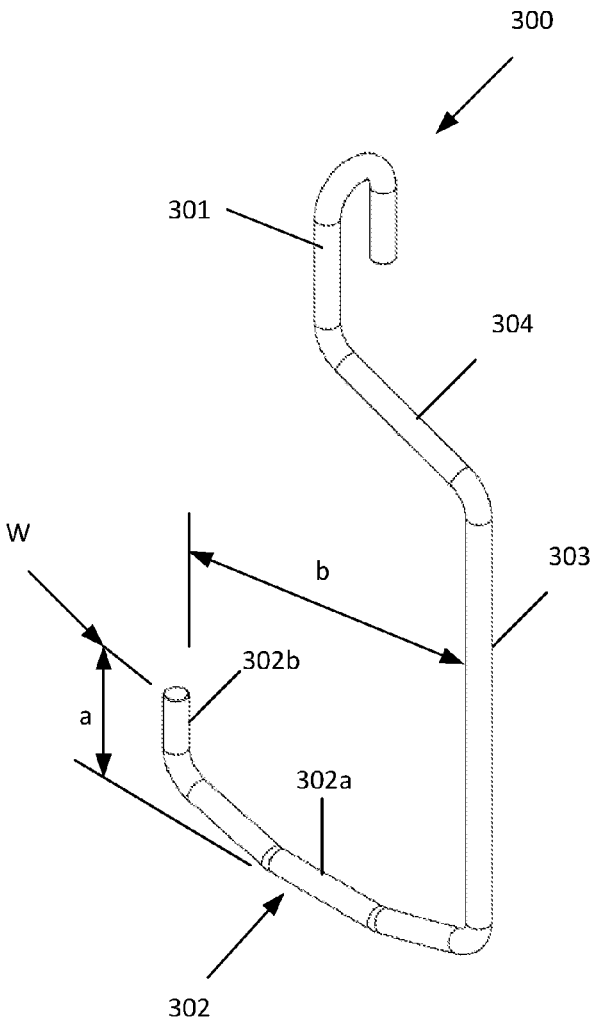
FIGS. 3A and 3B show embodiments of a weight holder.
Figure 3B:
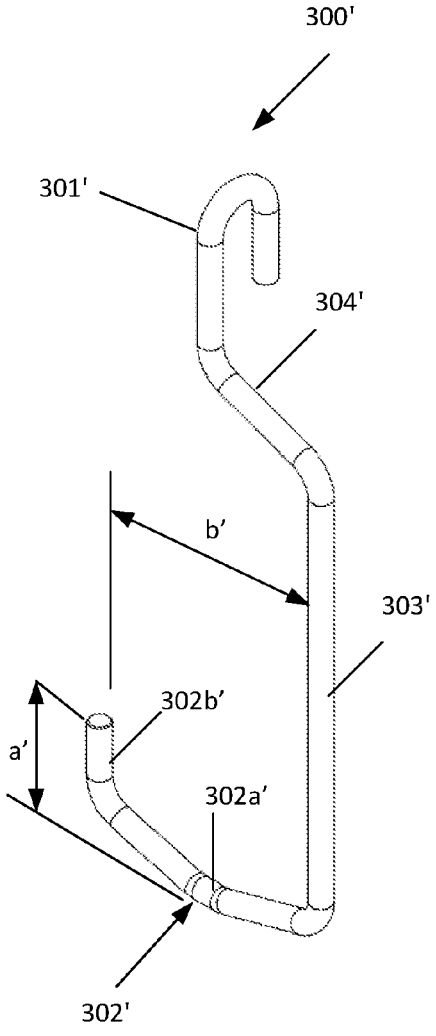

FIGS. 3A and 3B show, respectively, two plate holders 300 and 300' for coupling weight plates 1000 (FIGS. 4A to 5B) to the coupler 3 of the belt 1. The plate holders 300 and 300' have the same features, and differ in dimension to hold different number of weight plates. Therefore, the features will be described with reference to plate holder 300 and corresponding features of plate holder 300' will be denoted in FIGS. 3B, 5A, and 5B with the same numbers for holder 300 but appended with an "'". The plate holders 300 and 300' may be a wireform and may be made of a metal rod, such as a ⅜ inch steel rod. The material and dimension of the plate holders 300 and 300' is selected to be stiff enough and strong enough to avoid distortion of the holders.

The plate holder 300 has an upper hook portion 301 defines an opening configured to receive the coupler 3. The plate holder 300 has a lower hook portion 302 joined to the upper hook portion 301. The lower hook portion 302 has a generally horizontal segment 302*a* and a vertical segment 302*b*. A dimension "a" is less than a diameter of a center hole 102 in weight plates 1000 so that the vertical segment 302*a* may pass through the center hole 102 when such weight plates are received by the lower hook 302 in the direction of arrow W. The dimension "a" may be between ⅞ and 3 inches, and may be about 2 inches.

A vertical portion 303 and an offset portion 304 of the holder 300 position the upper hook portion 301 in spaced relation from the lower hook portion 302. As shown in FIG. 3A, the upper hook portion 301 and the lower hook portion 302 are vertically spaced and lie in respective planes that are perpendicular to each other. Also, the upper hook portion 301 is offset from the vertical portion 303 by the offset portion 304 so that the upper hook 301 lies in a plane that is located between the vertical segment 302*b* and a center of the horizontal segment 302*a*. The offset portion 304 facilitates balancing weight plates 1000 held by the holder 300 so that they remain substantially vertically oriented when they are hung by the holder 300 from the coupler 3 of the belt 1.

Figure 4B:
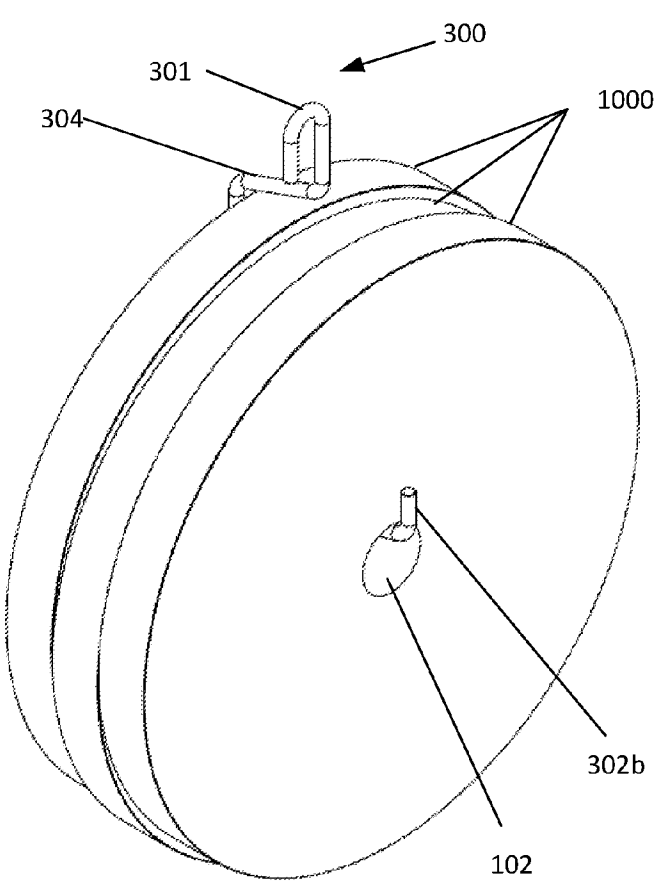
FIGS. 4A and 4B show opposite isometric views of the weight holder of FIG. 3A holding weight plates.
Figure 4A:
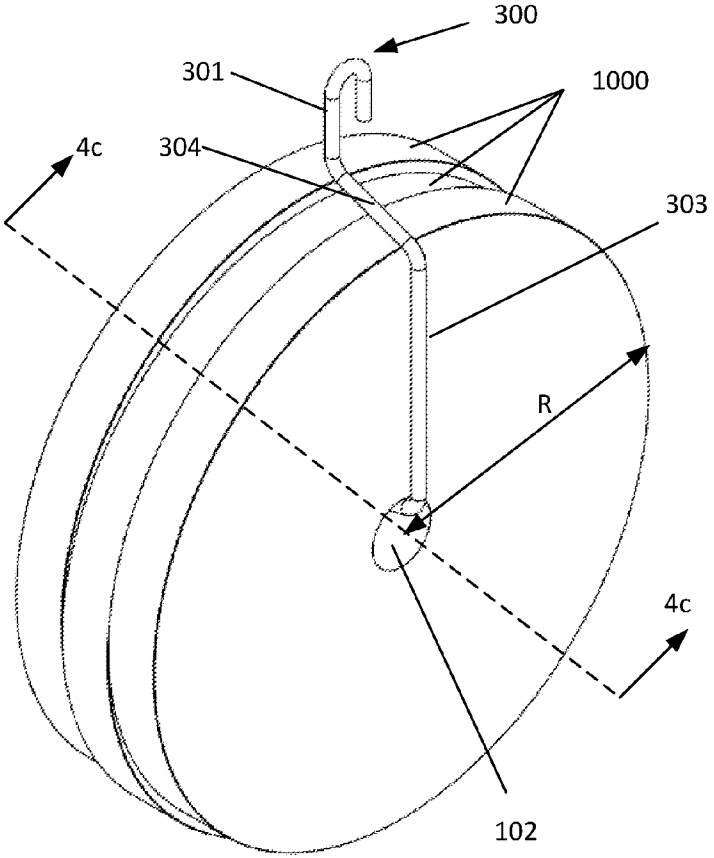
Figure 4C:
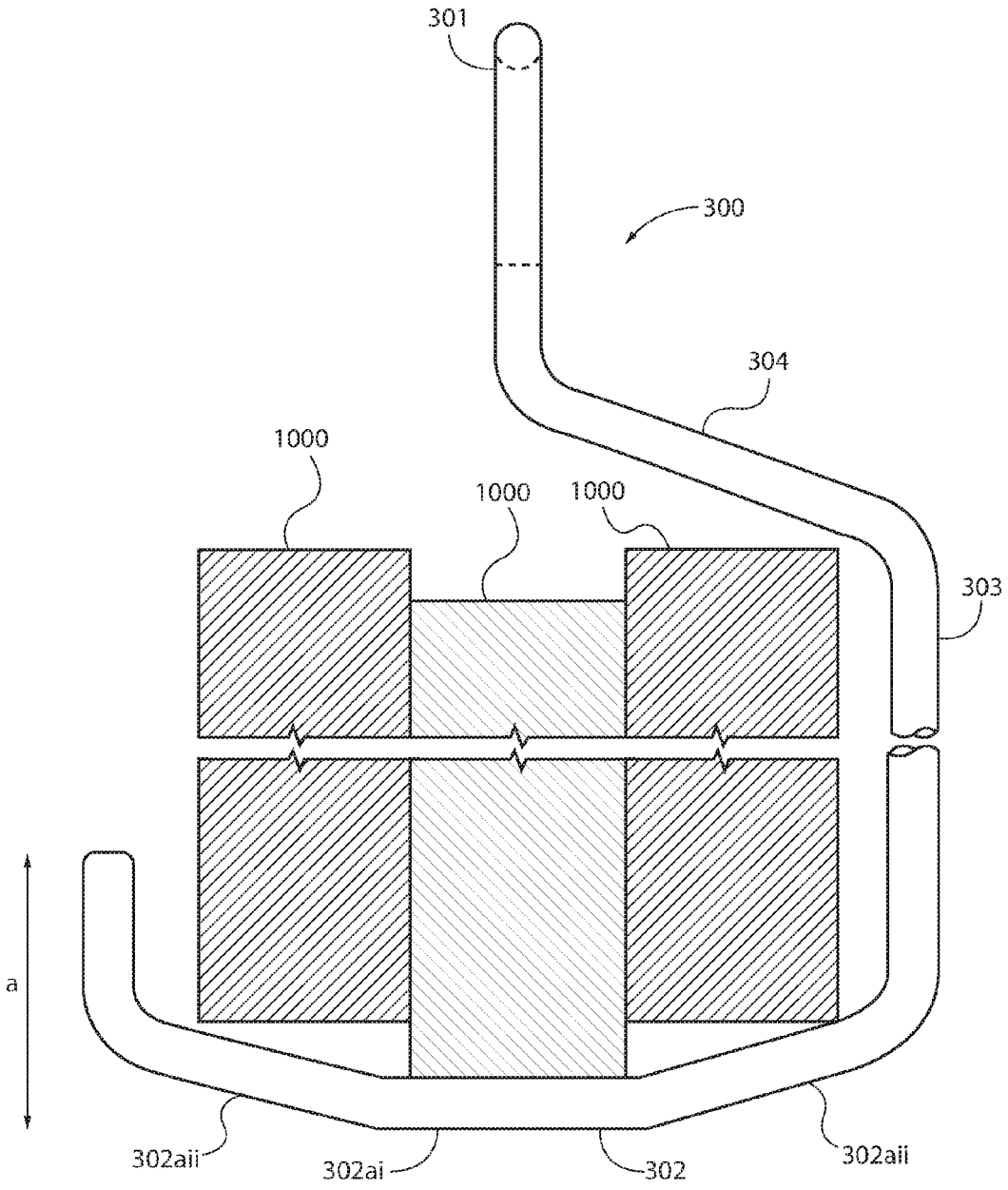
FIG. 4C shows the weight holder and weights of FIG. 4A along section 4C-4C.
Figure 5B:
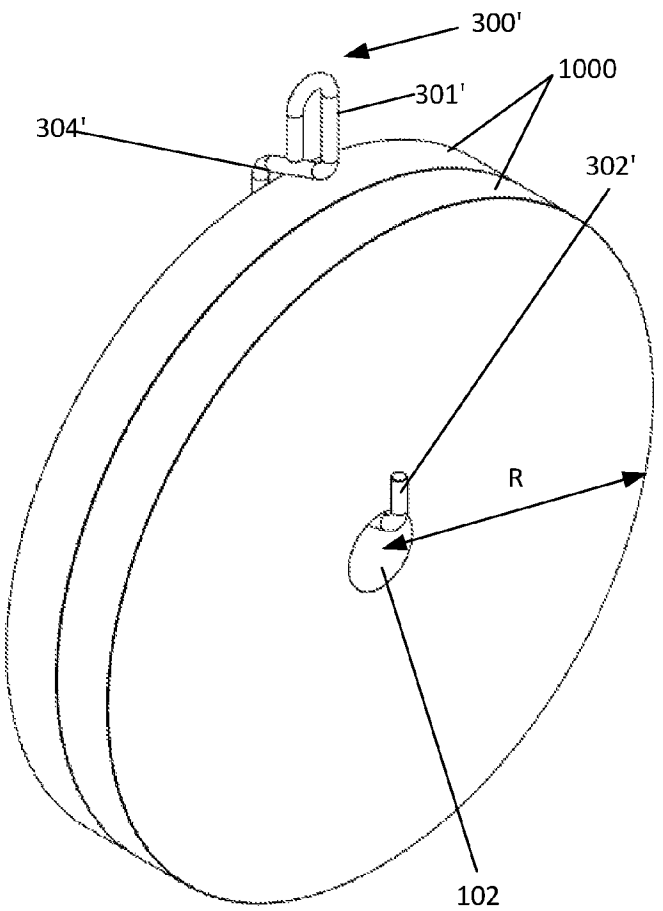
FIGS. 5A and 5B show opposite isometric views of the weight holder of FIG. 3B holding weight plates.
Figure 5A:
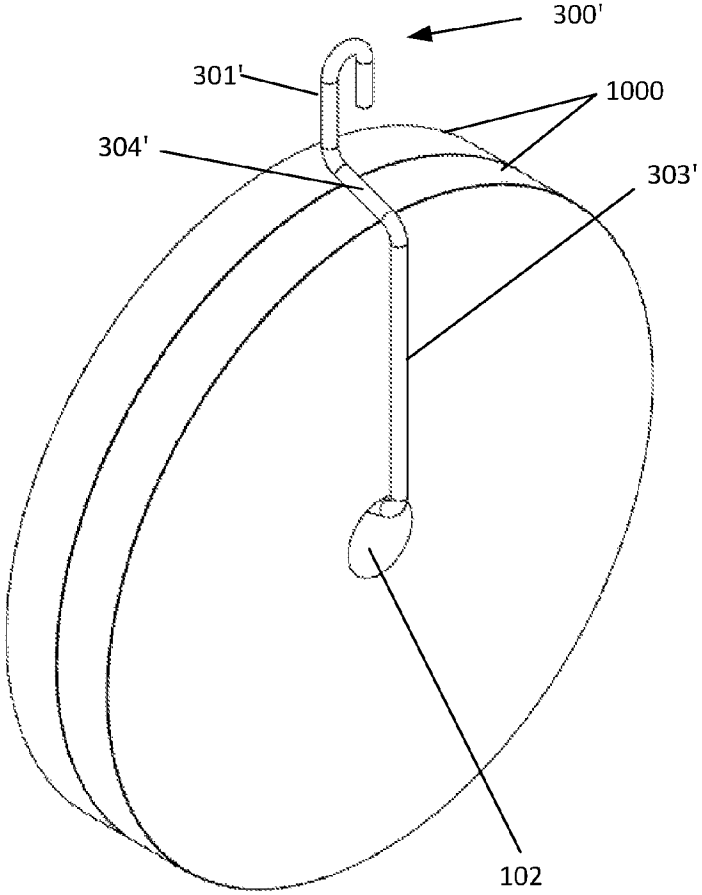

As shown in FIGS. 3A and 4C, the horizontal segment 302*a* of holder 300 has a dimension "b", which represents a loading width for loading weight plates onto the lower hook portion 302. The weight plates 1000 are held within the loading width "b". In order to accommodate and hold more weight plates 1000, the loading width "b" is larger than a corresponding dimension "b'" of the horizontal portion 302*a*' of holder 300'. The loading width "b" of plate holder 300 may be about 5.75 inches to accommodate three weight plates having thicknesses of 1.5 to 1.75 inch. For example, as shown in FIGS. 4A to 4C, the holder 300 is shown holding three weight plates 1000 (e.g., three forty-five pound plates), while in FIGS. 5A and 5B, the holder 300' is shown holding two weightlifting plates 1000 (e.g., two forty-five pound plates). The curve of the vertical portion 302*b* prevents the plates 1000 from moving and falling from the holder 300.

FIG. 4C shows a section view of the holder 300 along section 4C-4C in FIG. 4A. As shown in FIG. 4A, the vertical portion 303 has a length that corresponds generally to a radius "R" of the weightlifting plates 1000. The radius may be 4 to 9 inches. As shown in FIG. 4C, the horizontal segment 302*a* has two side portions 302*aii* and a middle portion 302*ai* between the two side portions. The middle portion 302*ai* is generally horizontal and the two side portions 302*aii* extend at a plate centering angle with respect to the middle portion 302*ai*. In one embodiment, the plate centering angle is about 15 degrees. The plate centering angle of the side portions 302*aii* causes weight plates supported by the side portions to be urged towards the center of the horizontal segment 302*a*, and against any plate supported by the middle portion, if any.

The plate holder 300 may be configured to hold up to 135 pounds (three weight plates 1000 of 45 pounds each). The plate holder 300 facilitates loading weight plates 1000 and coupling them to the belt 1 by connecting the upper hook 301 to the coupler 3 of the belt 1. When the plate holder 300 is coupled to the belt 1, a user wearing the belt 1 may perform exercises such as dips, pull-ups, and squats. The plate holder 300 also facilitates decoupling the weight plates 1000 from the belt 1 by disconnecting the hook 301 from the coupler 3 of the belt 1. Thus, when the user wishes to stop exercising, the user may unhook the upper hook 301 from the coupler 3 to disconnect the weight plates 1000 from the belt 1. Also, it may be more convenient to attach the plate holder 300 to the coupler 3 first and then load the plate hanger 300 with weight plates 1000, e.g., one at a time. Furthermore, the user can also change the weight plates 1000 between exercises without ever having to decouple the plate holder 300 from the belt 1. The plate holder 300 may improve the safety for a user by preventing the weight 1000 from being accidentally dropped or from falling off the belt 1. The plate holder 300 may also improve locating the weight 1000 relative to the user so that the weight does not pinch, scratch, or hit the user during exercise activity with the weight 1000. Further, the relatively small size of the plate holders 300 and 300' facilitates carrying and storing the holders in a user's own gym bag.

In use, a user can band the belt 1 about the user's waist and can connect coupler 3 to the ends 4*a*, 4*b* (or slightly further away from the ends) of the chain 4 to tighten the belt 1 sufficiently so that the padding 2 grips the user's waist so that the belt 1 cannot move downward over the user's hips. With the belt 1 banded about the user's waist, the user can attach the upper hook 301 of the holder 300 to coupler 3. The user can then lift the weight plates 1000 up and down by moving the belt 1 up and down by movement of their hips, such as during a squatting exercise. When the weight of the weight plates 1000 hangs from the belt 1, the weight of the weight will be distributed to the user's hips rather than the wearer's back. Moreover, because some of the links 7 of the chain 4 are free to rotate and translate relative to the bolts 6, the weight can be distributed around the waist of the user without twisting the belt 1.

Figure 6A:
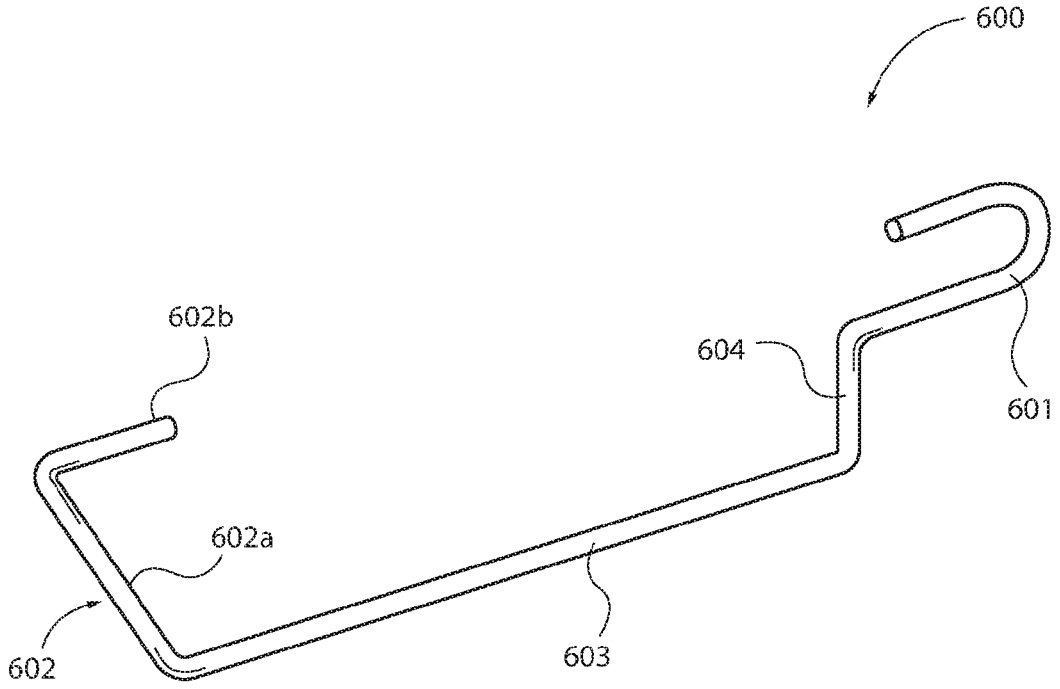
FIG. 6A is an isometric view of another embodiment of a weight holder.

FIG. 6A is an isometric view of another embodiment of a plate holder 600 for coupling weight plates 1000 to the coupler 3 of the belt 1. The plate holder 600 may be a wireform and may be made of a metal rod, such as a ⅜ inch steel rod. The material and dimension of the plate holder 600 is selected to be stiff enough and strong enough to avoid distortion of the holder 600.

The plate holder 600 has an upper hook portion 601 that defines an opening configured to receive the coupler 3. The plate holder 600 has a lower hook portion 602 joined to the upper hook portion 601. The lower hook portion 602 has a substantially horizontal segment 602*a* and a vertical segment 602*b*. A vertical portion 603 and an offset portion 604 of the holder 600 position the upper hook portion 601 in spaced relation from the lower hook portion 602.

Figure 6B:
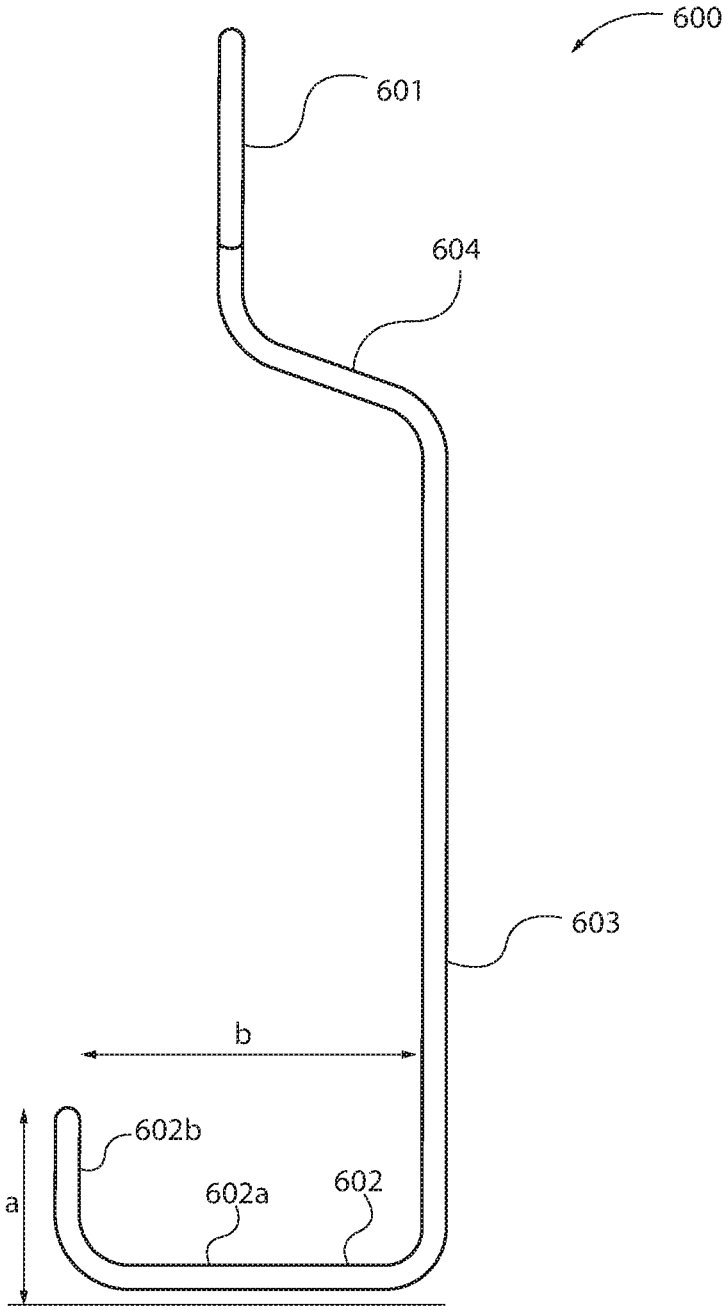
FIG. 6B is an elevation view of the weight holder of FIG. 6A.

The horizontal segment 602*a* may be angled slightly less (2 to 5 degrees) than 90 degrees with respect to the vertical portion 603, as shown most clearly in FIG. 6B. Specifically, in one embodiment the horizontal segment 602*a* may be angled about 87.5 degrees with respect to the vertical portion 603 (e.g., angled about 2.5 degrees with respect to the horizontal). Also shown in FIG. 6B, dimension "a" is less than a diameter of a center hole 102 in weight plates 1000 so that the vertical segment 602*a* may pass through the center hole 102 when such weight plates are received by the lower hook 602 in the direction of arrow W. The dimension "a" may be between ⅞ and 3 inches, and may be about 2 inches.

As shown in FIG. 6B, the upper hook portion 601 and the lower hook portion 602 are vertically spaced and lie in respective planes that are perpendicular to each other. Also, the upper hook portion 601 is offset from the vertical portion 603 by the offset portion 604 so that the upper hook 601 lies in a plane that is located between the vertical segment 602*b* and a center of the horizontal segment 602*a*. The offset portion 604 facilitates balancing weight plates 1000 (FIG. 6C) held by the holder 600 so that they remain substantially vertically oriented when they are hung by the holder 600 from the coupler 3 of the belt 1.

Figure 6C:
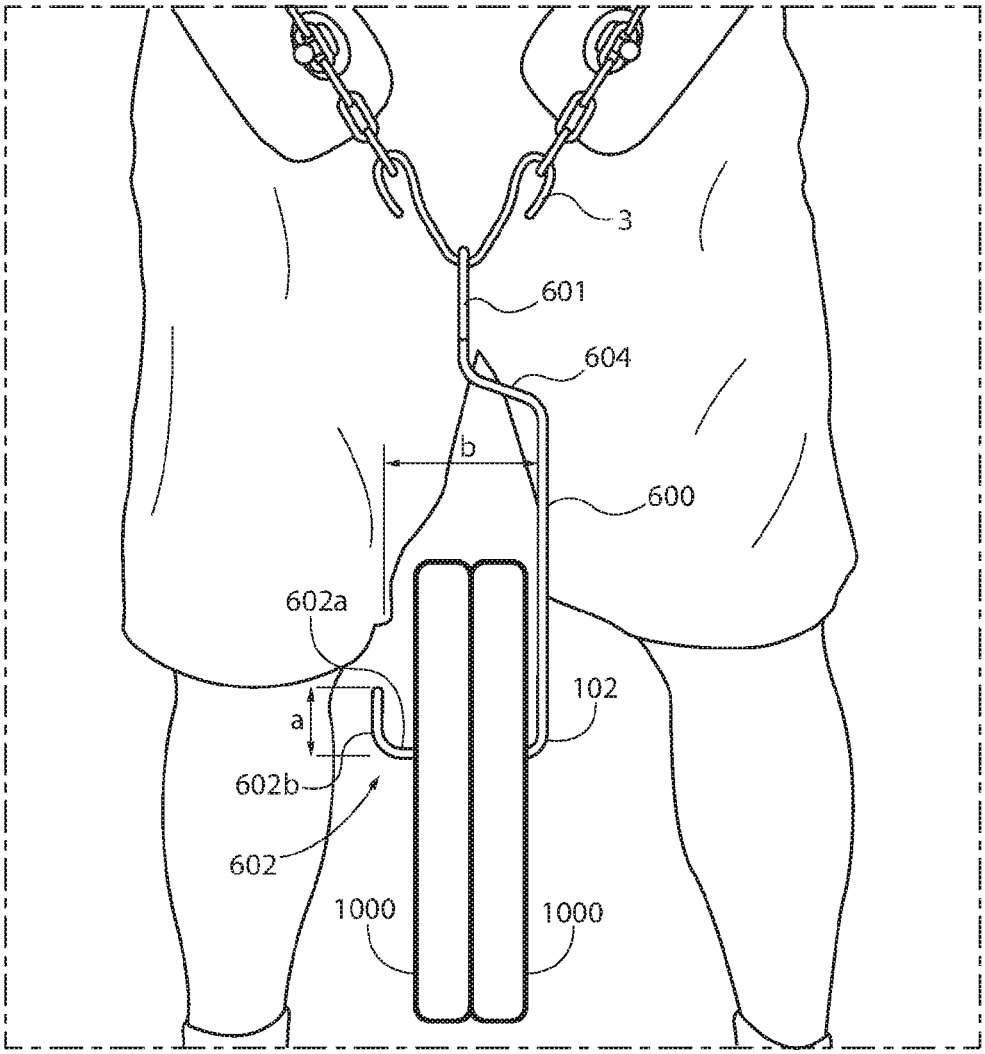
FIG. 6C shows the weight holder of FIG. 6A holding weights and coupled to the weightlifting belt of FIG. 1 worn by a user.

As shown in FIG. 6B, the horizontal segment 602*a* of holder 600 has a dimension "b", which represents a loading width for loading weight plates onto the lower hook portion 602. The weight plates 1000 are held within the loading width "b". The loading width "b" of plate holder 600 may be about 4 inches to accommodate two weight plates having thicknesses of 1.5 to 1.75 inch. For example, as shown in FIGS. 6C, the holder 600 is shown holding two weight plates 1000 (e.g., two forty-five pound plates). The vertical portion 602*b* prevents the plates 1000 from moving and falling from the holder 600. Also, the slight angle, which may be 2 to 5 degrees, that the horizontal segment 602*a* makes with the horizontal, biases the plates 1000 to slide toward the vertical portion 603 of the holder 600.

FIG. 6C also shows that the plate holder 600 may be coupled to the belt 1 and used in substantially the same way as weight holders 300 and 300'. That is, the plate holder 600 may be loaded with weight plates 1000 and then coupled to the coupler 3 of the belt 1 by hooking the upper hook 601 to the coupler 3. Thereafter, the user may perform exercises wearing the belt 1.

Figure 6D:
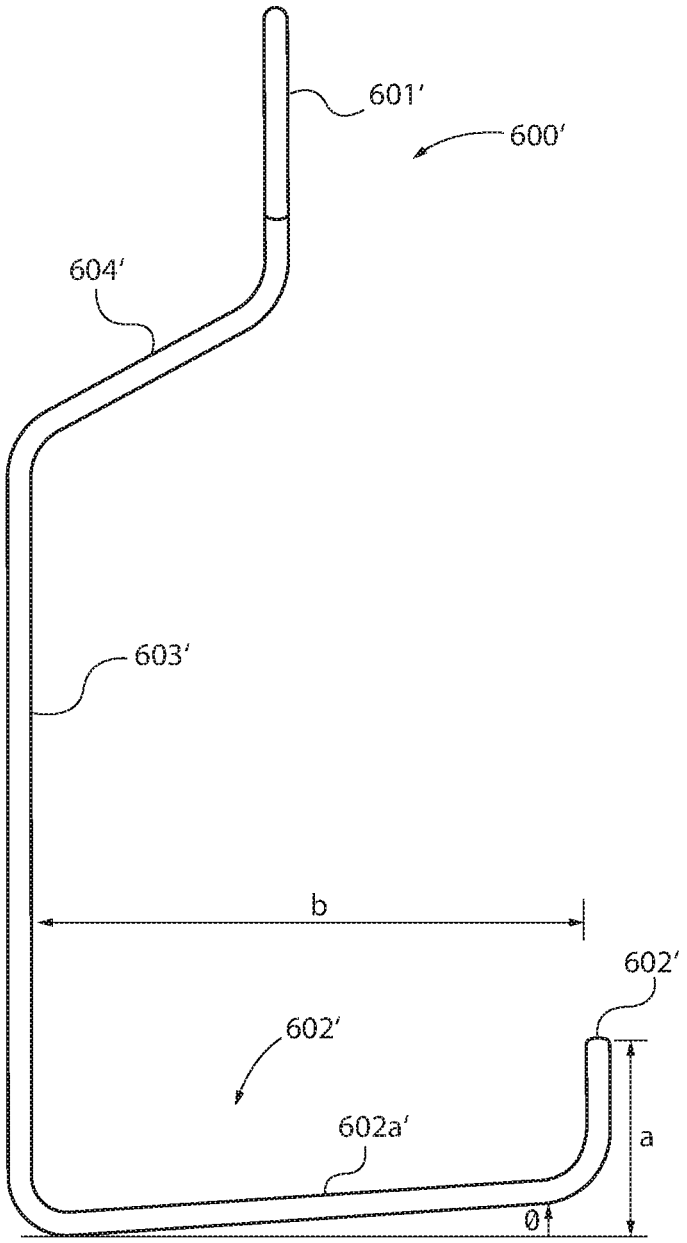
FIG. 6D shows an alternative version of the weight holder of FIG. 6A and configured to hold additional weight plates.

FIG. 6D shows a larger version of a holder than that of plate holder 600 which may accommodate loading more weight plates 1000. Specifically, FIG. 6D shows a weight holder 600', that has features corresponding to those of holder 600 appended with a "'". Notably, the holder 600' has a horizontal segment 602*a*', which has a larger loading width "b" than that of the holder 600 to accommodate more weight plates than holder 600. The holder 600' may accommodate three forty-five pound plates along its horizontal segment 602'. Also, to hold the additional weight, the holder 600' may be formed from a steel rod having a diameter of about 7/16 inch.

Figure 7:
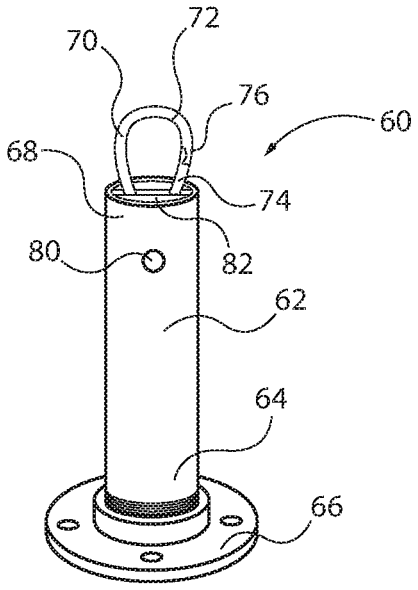
FIG. 7 shows yet another embodiment of a weight holder.
Figure 8:
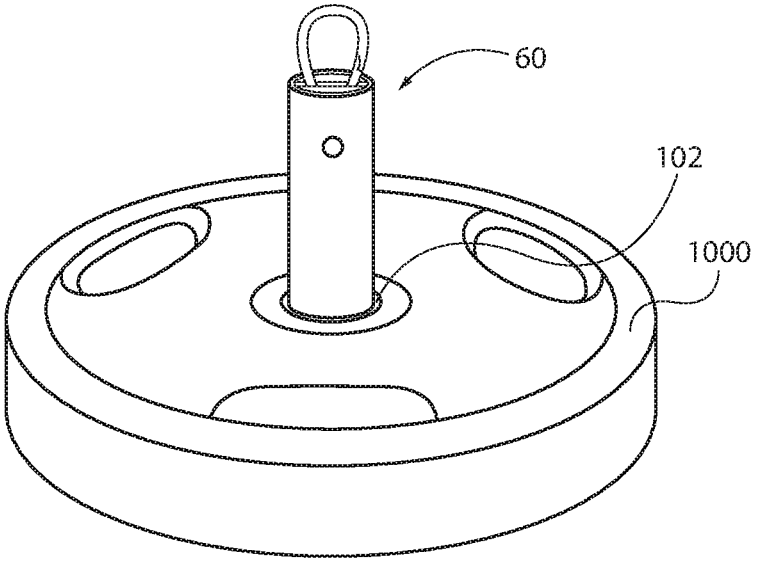
FIG. 8 shows the weight holder of FIG. 7 holding a weight plate.

Turning now to FIGS. 7 and 8, another weight-supporting attachment 60 is shown and includes a post 62 formed as a tube dimensioned to stably accept weight plate(s) 1000 at their center holes 102. The tube 62 is preferably made of metal, and more preferably made of steel, and about 2 inches in diameter, with preferably a 1/8 inch wall sized for strength. A lower end 64 of the tube is provided with, preferably by threaded attachment, a flange 66 larger than the center hole 102 of the weight plates 1000 that supports the weight plates and also acts as a stand to retain the post in an upright standing position when not being used. An upper end 68 of the tube is provided with a spring catch 70 retained partially inside the upper end. The spring catch 70 includes a hook 72 and spring-loaded gate 74 that interfaces with an end 76 of the hook. The retained end of the spring catch 70 is held within the tube 62 by a diametric crossing rod 80, preferably 3/8 diameter steel. The spring catch 70 is laterally spaced in the center of the tube 62 by semi-cylindrical spacers 82, which are also held in place by the diametric crossing rod 80. The tube 62 can be various lengths to accommodate less or greater weight. In one embodiment, the tube is 10" in length and intended to accommodate approximately up to 200 pounds. In another embodiment, the tube is shorter, approximately 5" in length, and intended to accommodate up to 100 pounds. In yet another embodiment, the tube is longer, approximately 16" in length, and intended to accommodate up to 300 pounds of weight.

Figure 9A:
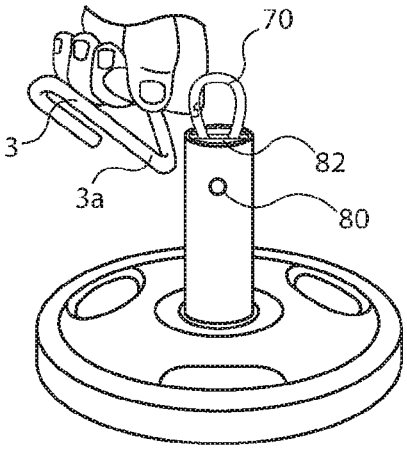
FIGS. 9A and 9B illustrate a sequence of coupling the weighted weight holder of FIG. 8 to a coupler of the weight belt of FIG. 1.
Figure 9B:
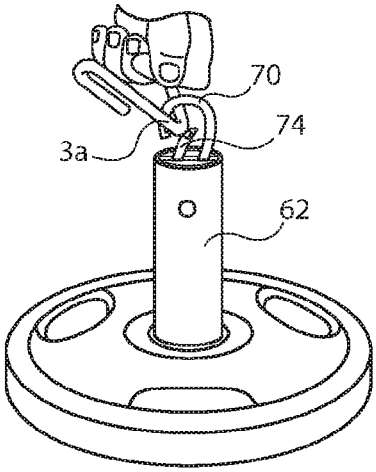
Figure 10A:
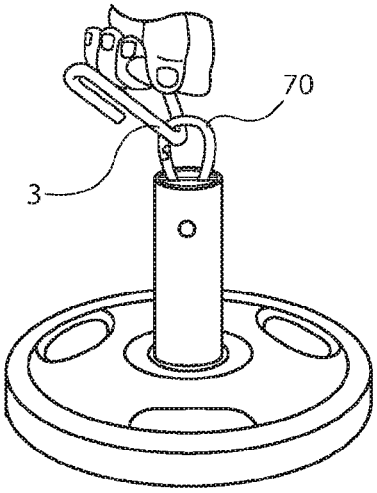
FIGS. 10A to 10C illustrate a sequence of decoupling the weighted weight holder of FIG. 8 from a coupler of the weight belt of FIG. 1.
Figure 10B:
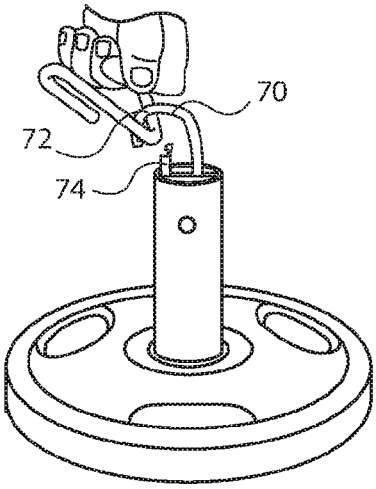
Figure 10C:
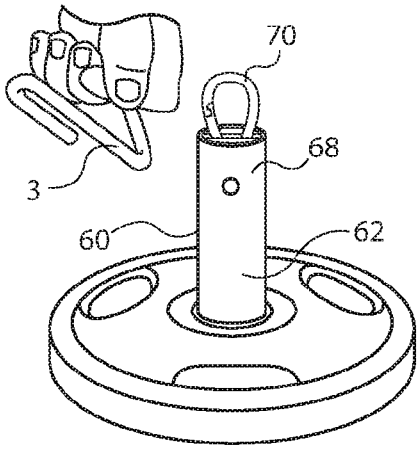

Turning to FIGS. 9A and 9B, a user wearing belt 1 can insert the 'V' 3*a* of the buckle 3 into the spring catch 70 by rotating the gate 74 toward the center of the tube 62. Then, referring to FIGS. 10A to 10C, the buckle 3 can be detached from spring catch 70 by rotating the hook 72 in an opposite direction relative to the gate 74 to open the catch and free the buckle. Importantly, the attachment and detachment of the first attachment 60 relative to the buckle 3 can be a one-handed operation. Where the belt 1 is configured with clip 3' in place of buckle 3, the solid portion of the clip 3' is moved in the same way as the 'V' 3*a* of buckle 3 to insert and remove from the spring catch 70. The spacers 82 aid in limiting lateral movement of the spring catch 70 during insertion and removal of the buckle 3. Specifically, the spacers limit movement of the spring catch 70 from moving in a direction transverse to its direction of rotation, i.e., in a direction along the length of the crossing rod 80. This stabilizes the spring catch 70 during the insertion and removal of the buckle 3 from spring catch 70.

With the weighted attachment 60 loaded with one or more weight plates 1000 and coupled to the belt 1, the worn belt can be used for several exercises, including squatting, toe-raises, loaded planks, loaded hip dips, loaded push-ups, loaded pull-ups, loaded dips, and loaded hip thrusts. The hip-mounted belt removes the load from the user's back and supports the weights at the hips and legs.

Figure 11:
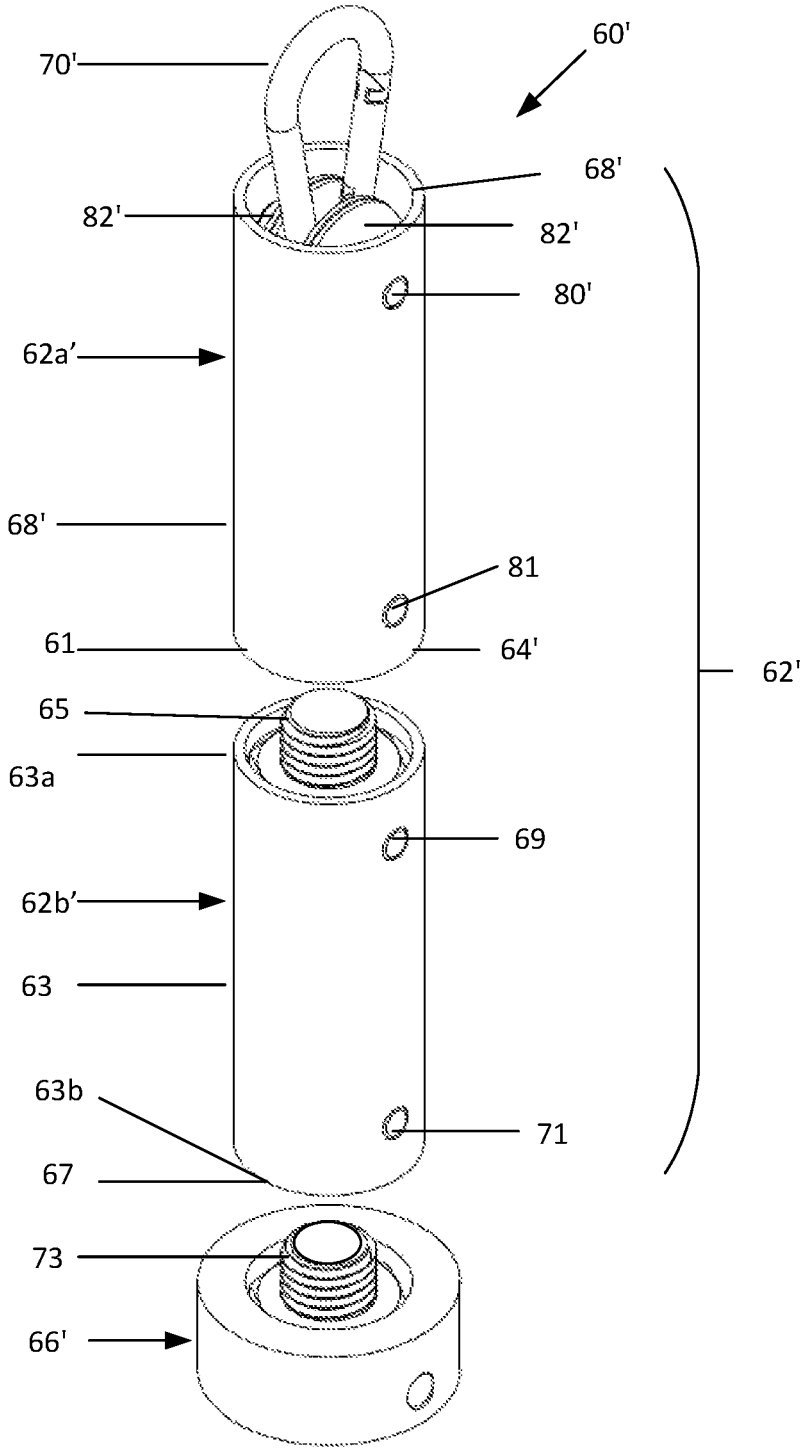
FIG. 11 shows an alternative embodiment of the weight holder of FIG. 7.

FIG. 11 illustrates an alternative embodiment to the weight holder 60 of FIG. 7. As shown in FIG. 11, weight holder 60' includes a post 62' which includes an upper portion 62*a*' and an optional extension 62*b*', which are configured to removably connect together, such as by threaded engagement. The upper portion 62*a*' and extension 62*b*' may be dimensioned to stably accept weight plate(s) 1000 at their center holes 102. The upper portion 62*a*' and extension 62*b*' are preferably made of metal, and more preferably made of steel, and about 2 inches in diameter, with preferably a 1/8 inch wall sized for strength. The upper portion 62*a*' is formed like post 62 and has a female threaded connector 61 at a lower end 64'. The connector 61 is fixed to the tube of the post 62 by crossing rod or bolt 81. Extension 62*b*' is formed as a tube 63 having an upper end 63*a* provided with a male threaded connector 65 and a lower end 63*b* provided with a female threaded connector 67 (not shown). The male threaded connector 65 and the female threaded connector 67 are each independently fixed in the tube 63 with respective crossing rods or bolts 69 and 71.

The weight supporting holder 60' also includes a base 66', which is configured to removably connect to the lower end of the extension (when present) and the lower end of the upper portion 62*a*' when the extension is not present. The base 66' has a diameter that is larger than the center hole 102 of the weight plates 1000. The base 66' supports the weight plates 1000 and also acts as a stand to retain the post 62' in an upright standing position when not being used. The base 66' has an upper end that is provided with a male threaded connector 73, which is configured to mate with the female threaded connectors 61 and 67. The wall of the upper portion 62' may have a vertical length of about 5 inches and the wall of the extension 62*b*' may have a vertical length of about 5 inches. In that example, when both the upper portion 62*a*' and the extension 62*b*' are connected together, the post 62' has a nominal length of 10 inches and the post 62' may accommodate approximately up to 200 pounds. When the extension 62*b*' is omitted in the example, the post 62' has a shorter, 5-inch length, and may accommodate up to 100 pounds.

An upper end 68' of the post 62' is provided with a spring catch 70' retained partially inside the upper end 68'. The spring catch 70' is constructed like the spring catch 70 described above in connection with FIGS. 7 to 10C, with the spring catch 70' being mounted on an axle 80' that is coupled to the upper portion 62' so that the entire spring catch 70' may pivot about the axle 80' during introduction and removal of the coupler 3, described above. Spacers 82' are mounted on the axle 80' between the spring catch 70' and inside of the tube of the upper end 68' of the post 62'. The spacers 82' contact the upper end 68' and provide lateral stabilization to the spring catch 70'. Specifically, the spacers 82' limit movement of the spring catch 70' from moving in a direction transverse to its direction of rotation, i.e., in a direction along the length of the crossing rod 80'. This stabilizes the spring catch 70' during the insertion and removal of the buckle 3 of the belt 1 from spring catch 70'.

Figure 12:
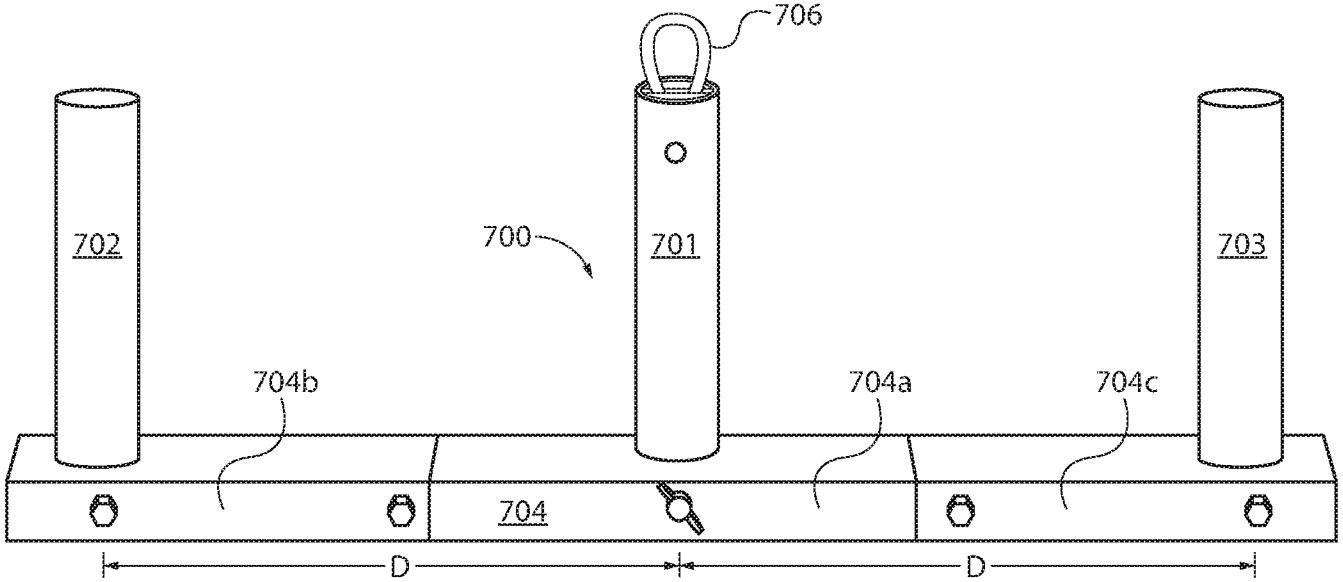
FIG. 12 shows yet another embodiment of a weight holder.
Figure 13:
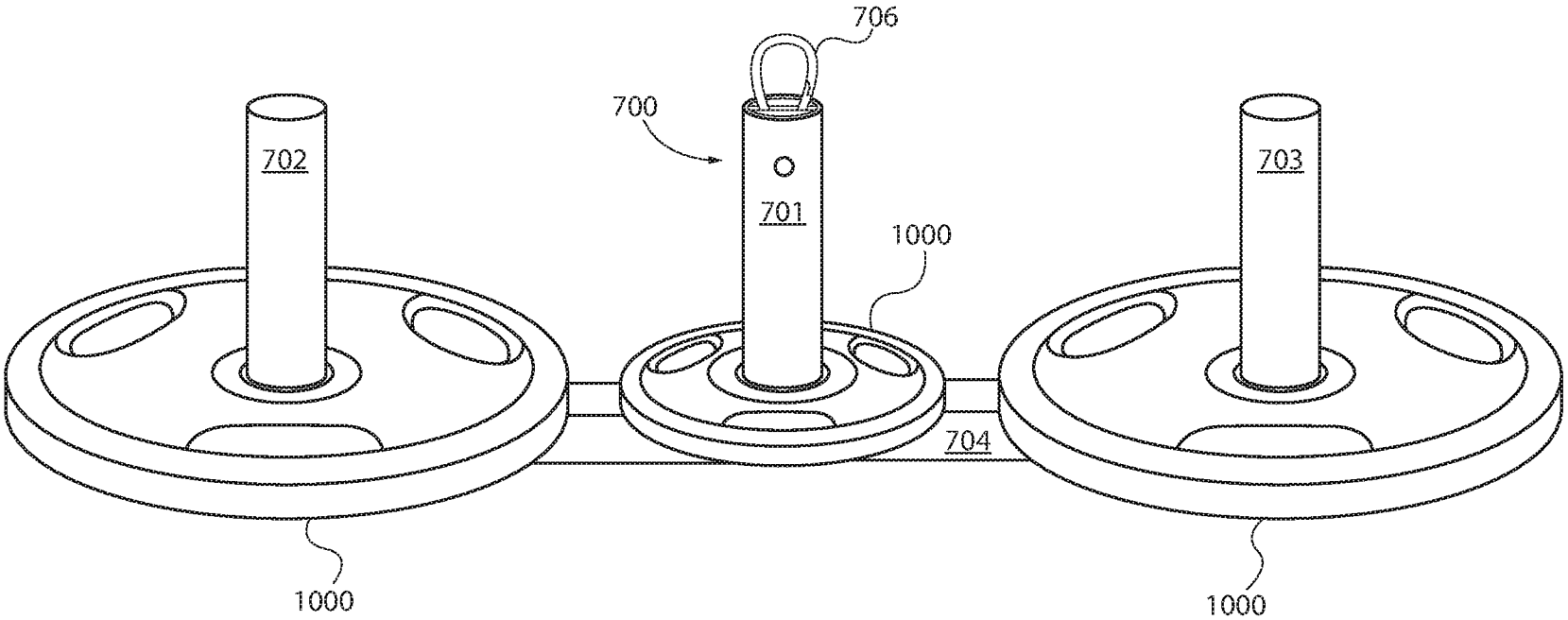
FIG. 13 shows the weight holder of FIG. 12 holding weight plates.

FIGS. 12 and 13 show another embodiment of a weight holder 700, which may be coupled to the weight belt 1. The weight holder 700 includes a plurality of weight holding posts 701, 702, and 703. The center post 701 is constructed like post 62 described above. However, instead of flange 66 being connected to the lower end, post 701 is coupled to an elongated base 704, which extends to posts 702 and 703. In the embodiment shown in FIGS. 12 and 13, the base 704 is formed of three modular, connected segments 704*a*, 704*b*, and 704*c*. Center segment 704*a* is connected directly to the center post 701. Post 702 is connected directly to segment 704*b* and post 703 is connected directly to segment 704*c*. Posts 702 and 703 are symmetrically spaced from center post 701 a distance D. Posts 701, 702, and 703 each have a diameter that is less than the center hole of weight plate 1000.

Each post 701, 702, and 703 is configured to slide through the center hole 102 of one or more weight plates 1000, as shown in FIG. 13. The center post includes a spring catch 706, constructed in the same manner as spring catch 70. Also, the spring catch 706 is configured to connect to couplers 3 and 3' in the same way as spring catch 70, and acts as lifting point for the weight holder 700. Preferably, the weight plates 1000 are loaded evenly, as shown in FIG. 13 (or at least symmetrically about the center point 701), so that the holder 700 will remain relatively horizontal when lifted from the spring catch 706 of the center post 701. To use the weight holder, a user loads weight plates 1000 on the posts 702 and 703 only, 701 only, or all of the posts 701-703. The user straddles the loaded weight holder 700 wearing the belt 1 and couples the coupler 3 of the belt 1 to the spring catch 706. When the weight holder 700 is coupled to the belt 1, the user may then proceed to perform exercises, such as squats. While all of the posts 701 to 703 can be loaded with the same size weight plates, it may be useful to load them with different size weight plates. For example, it may be useful for squatting exercises to load the center post 701 with smaller diameter weight plates than the posts 702 and 703 so that the user has ample space between the user's legs and is not forced to separate their legs more than normal for squatting exercises.

FIGS. 14A to 19 illustrate details of the construction of the weight holder 700, which may be assembled for use and disassembled for transportation as described in detail below. As will be apparent from the description below, the construction of the weight holder 700 facilitates quick assembly and disassembly for transport in a gym bag. Also, the construction of the weight holder 700 allows for greater weight loading in comparison with the previously discussed weight holders 300, 300', 600, 600', and 60, which may be restrictive for very strong weightlifting users. In addition, as will be appreciated, the weight holder 700, also allows relatively heavier loading without occupying room between the knees of the user. The user can place smaller diameter weight plates (e.g., 10 pounds) over the center post 701 and place heavier plates (e.g., 45 pounds) on the outer posts 702 and 703. One vertical layer of weight plates alone can provide 100 pounds of weight loading (45+10+45 pounds) and there is room for 5 layers (500 pounds) with the posts 701, 702, and 703 having diameters sized for a conventional squatting range for weight lifting exercises.

Figure 14A:
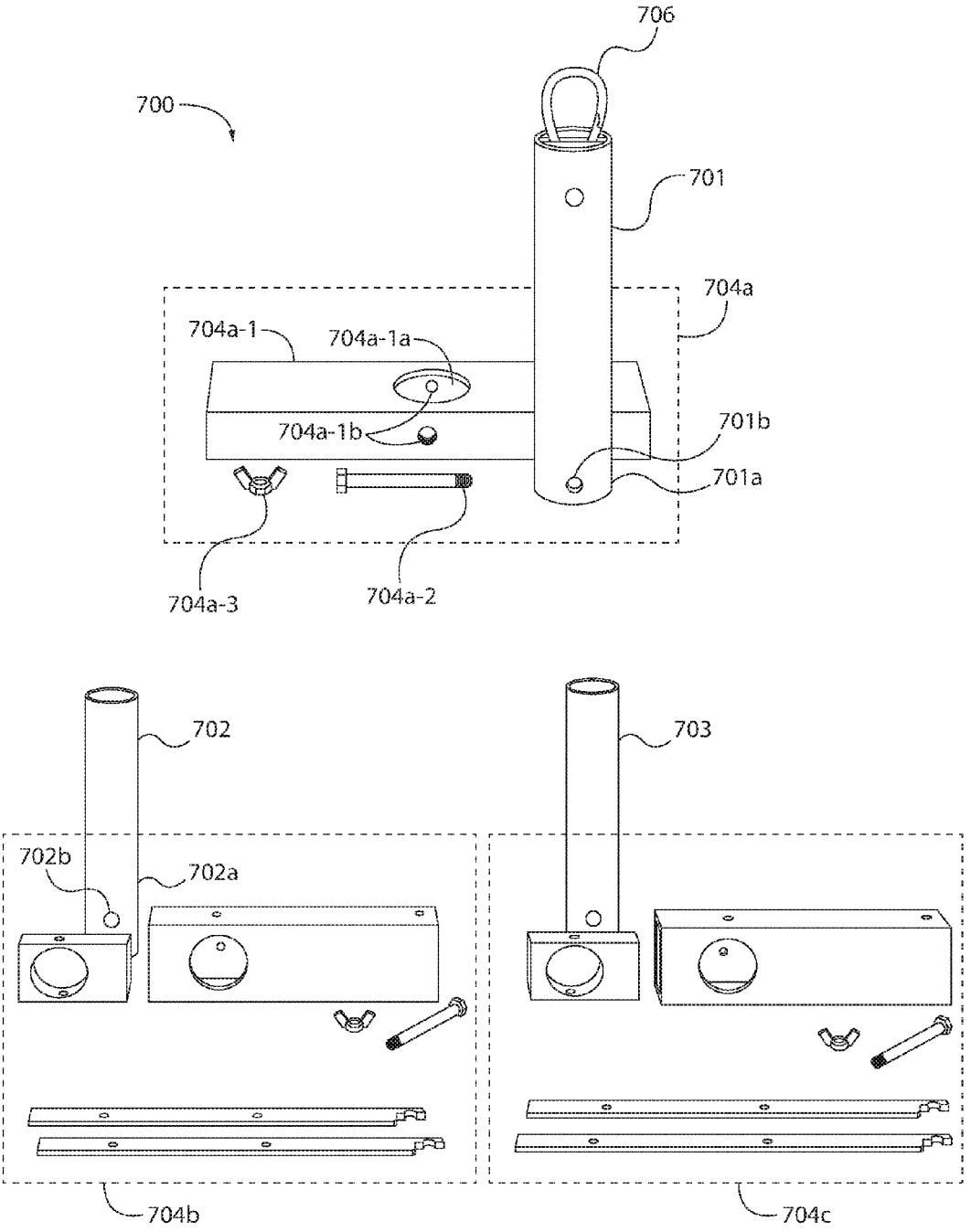
FIG. 14A illustrates the weight holder of FIG. 12 in a fully disassembled configuration.

FIG. 14A illustrates the weight holder 700 in a fully disassembled configuration. In the embodiment shown in FIG. 14A, segment 704*a* includes a rectangular tubular body 704*a*-1 that has a hollow interior. The body 704*a*-1 defines a hole 704*a*-1*a* on an upper surface to receive a lower end 701*a* of post 701. The body 704*a*-1 also defines through holes 704*a*-1*b* that extend perpendicular to the axis of hole 704*a*-1*a*. The through holes 704*a*-1*b* are configured to align with a through bore 701*b* defined in the lower end 701*a* of the post 701. The segment 704*a* includes a bolt 704*a*-2 and a mating wingnut 704*a*-3. The bolt 704*a*-2 is constructed to pass through holes 704*a*-1*b* and bore 701*b* to couple the post 701 to the body 704*a*-1.

Figure 14B:
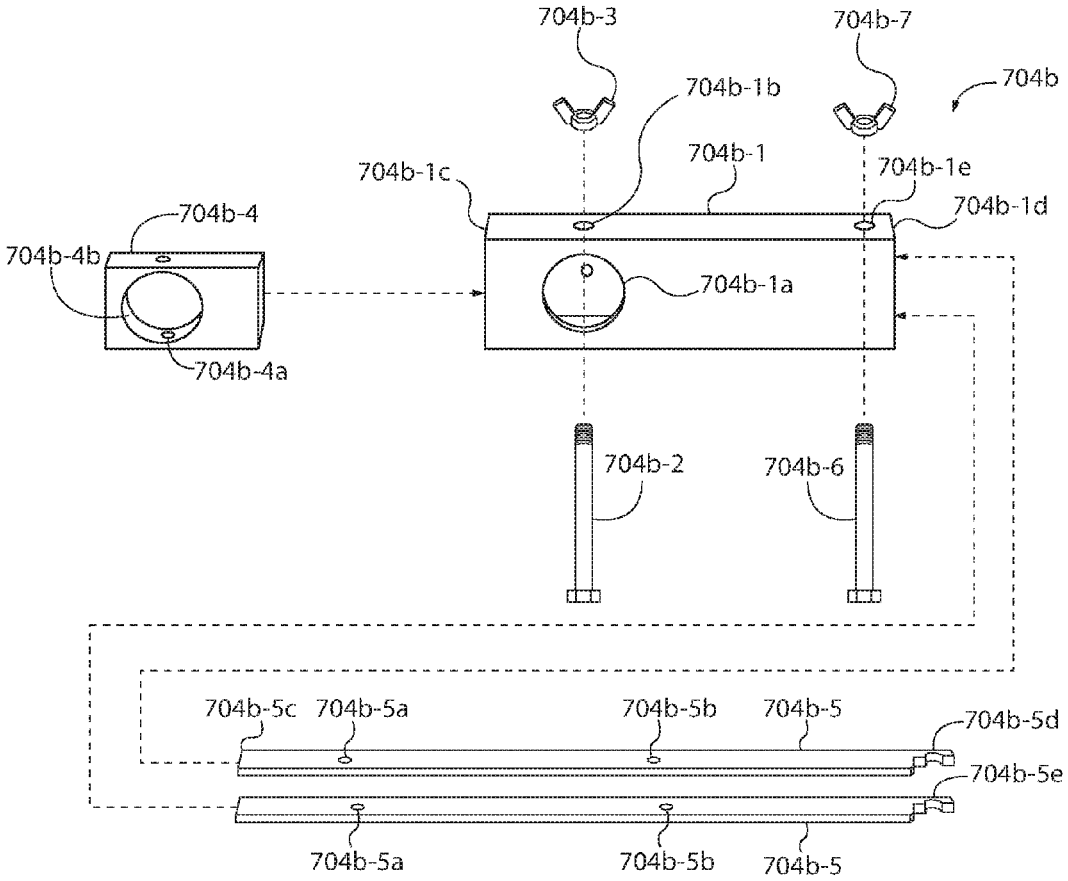
FIG. 14B illustrates an assembly view of one portion of the weight holder.

FIG. 14A also shows the components that comprise each of segments 704*b* and 704*c*. In the embodiment shown in FIG. 14A, segments 704*b* and 704*c* are identically constituted. Thus, a detailed description will be provided of segment 704*b* with respect to FIG. 14B, which will also serve to describe the identical segment 704*c*. As shown in FIG. 14B, segment 704*b* includes a body segment 704*a* includes a rectangular tubular body 704*b*-1 that has a hollow interior. The body 704*b*-1 extends between a first end 704*b*-1*c* and a second end 704*b*-1*d*. The body 704*b*-1 defines a hole 704*b*-1*a* through a top of the body. The hole 7040*b*-1*a* is configured to receive a lower end 702*a* of post 702 (FIG. 14A). Sides of the body 704*b*-1 also define a first set of holes 704*b*-1*b* that extend perpendicular to the axis of hole 704*b*-1*a*. The through holes 704*b*-1*b* are configured to align with a through bore 702*b* defined in the lower end 702*a* of the post 702. Also, the through holes 704*b*-1*b* are configured to align with holes 704*b*-4*a* formed in an insert 704*b*-4, which is configured to be inserted into the first end 704*b*-1*c*. The insert 704*b*-4 has a through hole 704*b*-4*b*, which may have the same dimensions as hole 704*b*-1*a*. Further, the body 704*b*-1 defines a second set of holes 704*b*-1*e* near the second end 704*b*-1*d* of the body.

Figure 16:
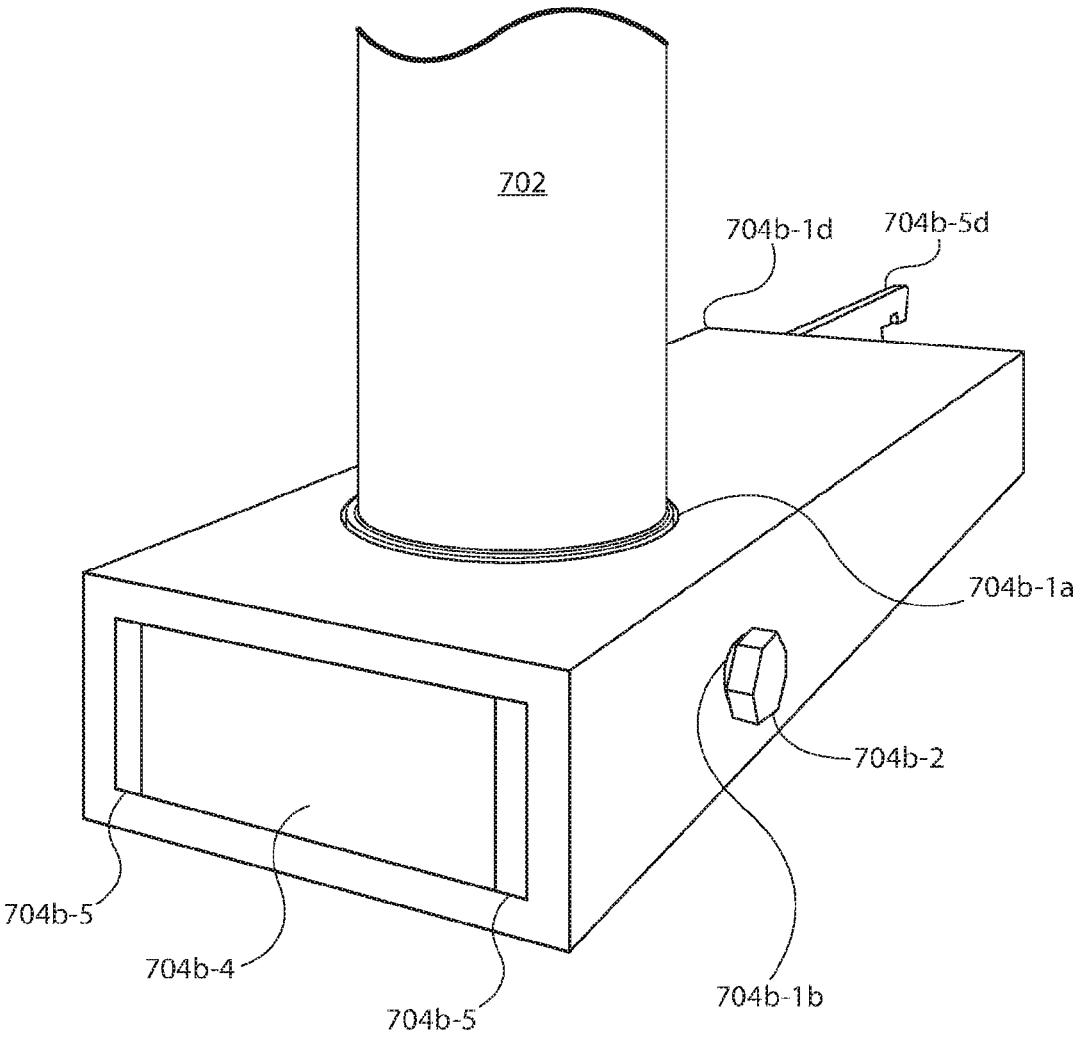
FIG. 16 illustrates a portion of the weight holder after assembly of additional components shown in FIG. 15.

The segment 704*b* also includes a set of elongated bars 704*b*-5, each of which is configured to be introduced into the body 704*b*-1 and extend in parallel spaced relation to each other along inner surfaces of the sides of the body 704*b*-1, as shown in FIG. 16. The bars 704*b*-5 extend from a first end 704*b*-5*c* to a second end 704*b*-5*d*. When assembled, the first end 704*b*-5*c* of the bar is aligned with the first end 704*b*-1*c* of the body 704*b*-1, while the second end 704*b*-5*d* extends from the second end 704*b*-1*d* of the body 704*b*-1, as shown in FIG. 16. Each bar 704*b*-5 defines a first hole 704*b*-5*a* and a second hole 704*b*-5*b*, that are configured to align, respectively, with holes 704*b*-1*b* and holes 704*b*-1*e*.

Each bar 704*b*-5 defines a semi-circular notch 704*b*-5*e* at the second end 704*b*-5*d*. The notches 704*b*-5*e* may be configured to engage or partially surround a rod or bolt, as discussed in greater detail below.

The segment 704*b* includes bolts 704*b*-2, 704*b*-6 and wingnuts 704*b*-3, 704*b*-7 to couple the bars 704*b*-5, the insert 704*b*-4, and post 702 to the body 704*b*-1 of segment 704*b*, as described in greater detail below.

Figure 15:
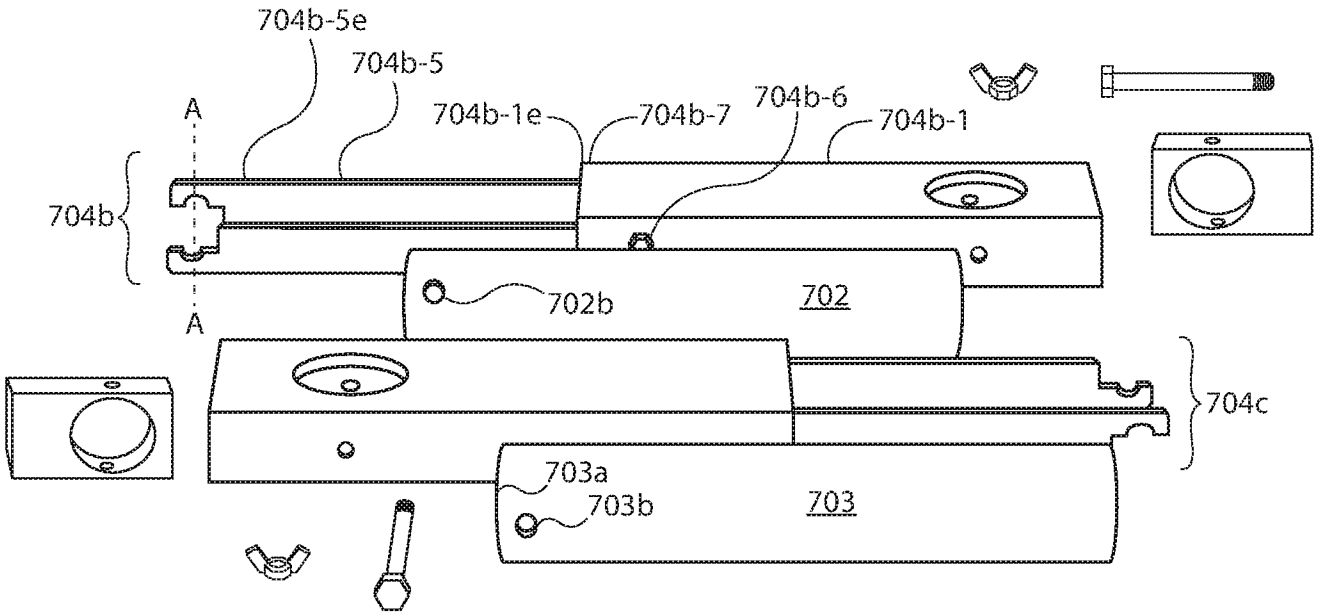
FIG. 15 illustrates the weight holder of FIG. 12 in a partially assembled configuration.

FIG. 15 shows segments 704*b* and 704*c* in a partially assembled state where the bars 704*b*-5 are coupled to the body 704*b*-1 with the bolt 704*b*-6 and the wingnut 704*b*-7. Specifically, the bolt 704*b*-6 is disposed through aligned holes 704*b*-1*e* of the body 704*b*-1 and holes 704*b*-5*b* of the bars 704*b*-5. Also shown in FIG. 15 is that notches 704*b*-5*e* are oriented in opposite directions, such that one notch opens upwards and one notch opens downward. Nonetheless, the notches 704*b*-5*e* are shown in alignment along axis A-A.

Also shown in FIG. 15 is the construction of post 702, which has a lower end 702*a* that defines a through bore 702*b*. The through bore 702*b* is configured to receive bolt 704*b*-2, as shown in FIG. 16. FIG. 16 shows the segment

704*b* further assembled with the insert 704*b*-4 and coupled to the post 702. The insert 704*b*-4 is disposed in the second end 704*b*-1*c* of the body 704*b*-1 between the bars 704*b*-5 so that the holes 704*b*-4*a* of the insert 704*b*-4 are aligned with holes 704*b*-1*b* of the body 704*b*-1. The lower end 702*a* of the post 702*b* may then be inserted through aligned holes 704*b*-1*a* and 704*b*-4*a* and the bore 702*b* may be aligned with holes 704*b*-4*a* of the insert 704*b*-4 are aligned with holes 704*b*-1*b* of the body 704*b*-1. The bolt 704*b*-2 may then be inserted through all of the aligned holes 704*b*-4*a*, 704*b*-1*a*, and the bore 702*b* and fastened with wingnut 704*b*-3, thereby coupling the post 702, the insert 704*b*-4, and the body 704*b*-1 together, as shown in FIG. 16. The segment 704*c* may be assembled in the same manner as segment 704*b* and the two segments may be joined to segment 704*a* and post 701 as follows.

Figure 17:
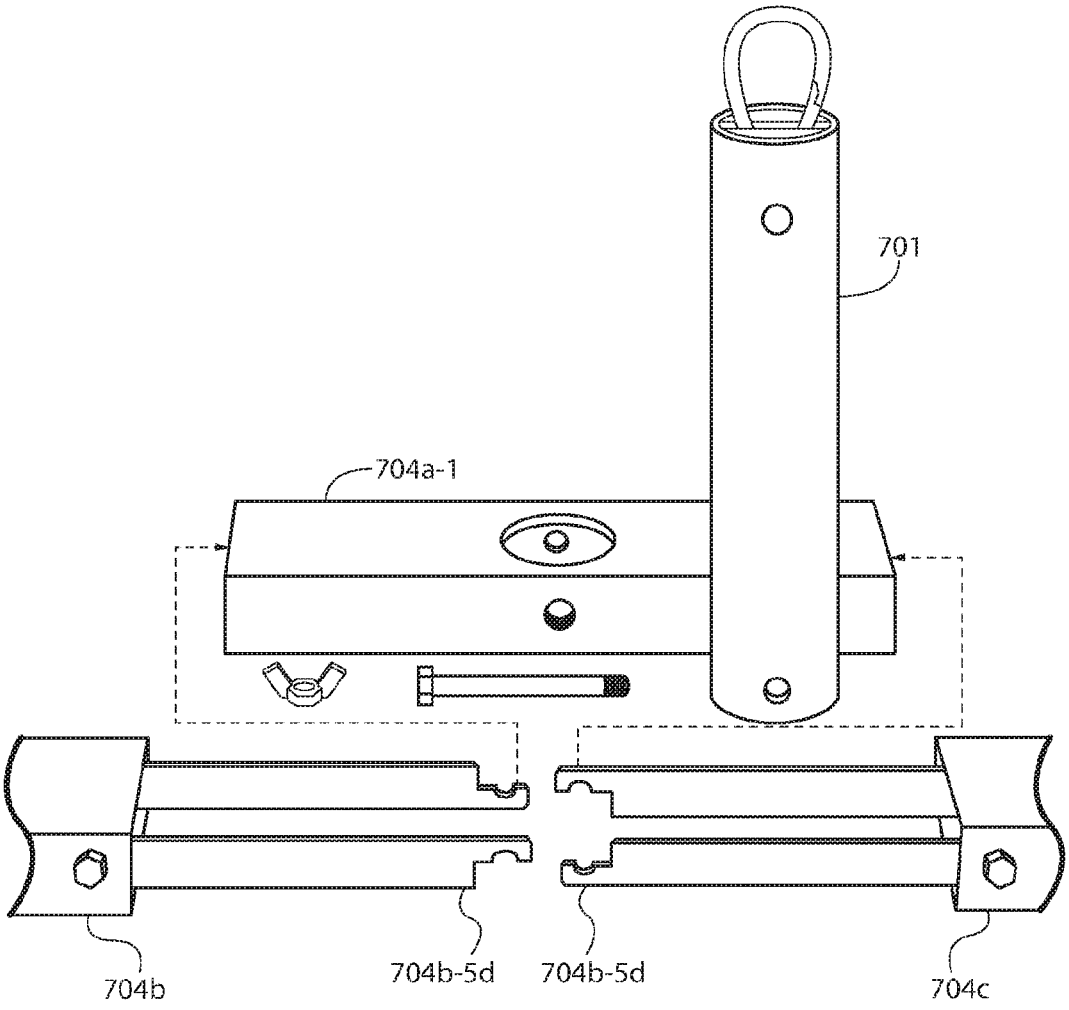
FIG. 17 illustrates details of an internal coupling arrangement of the weight holder of FIG. 12.
Figure 18:
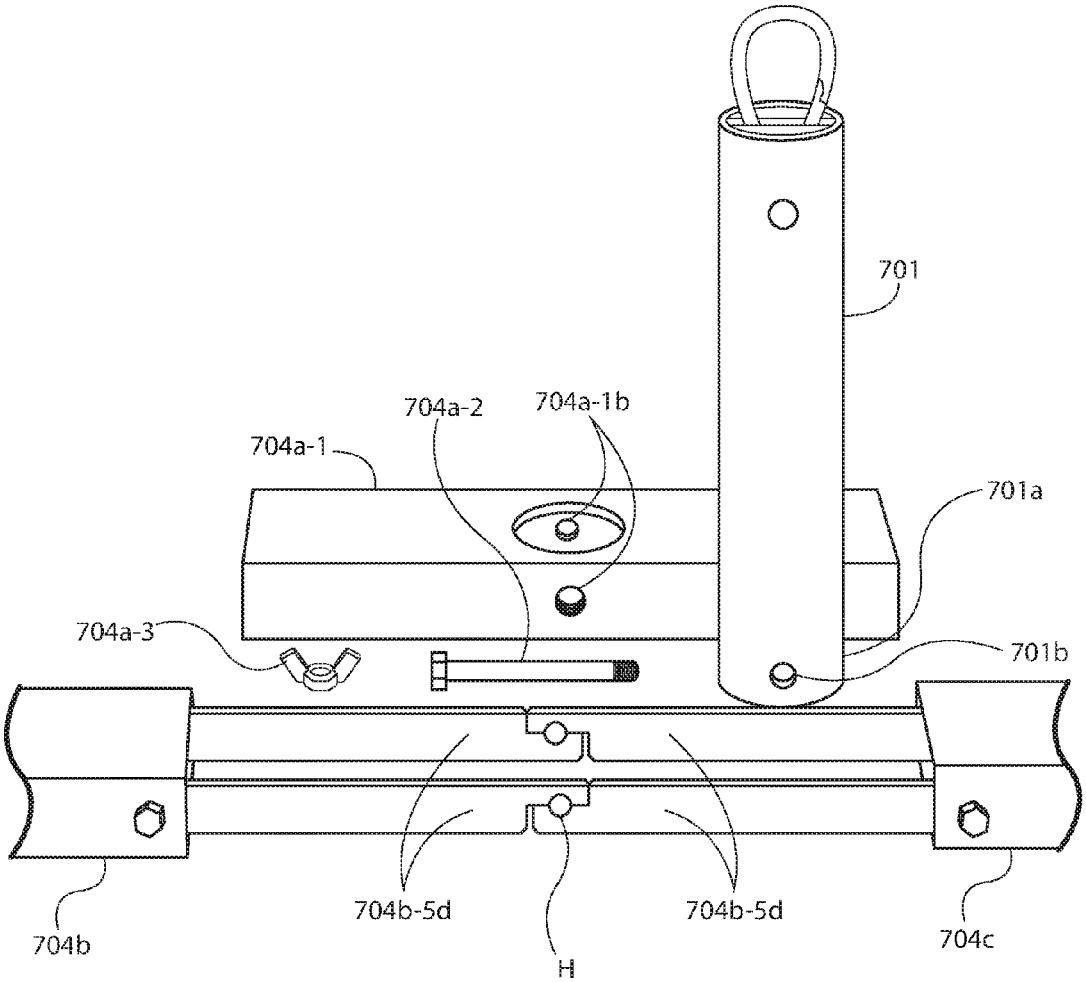
FIGS. 18 and 19 show a sequence of steps of coupling portions of the weight holder together.
Figure 19:
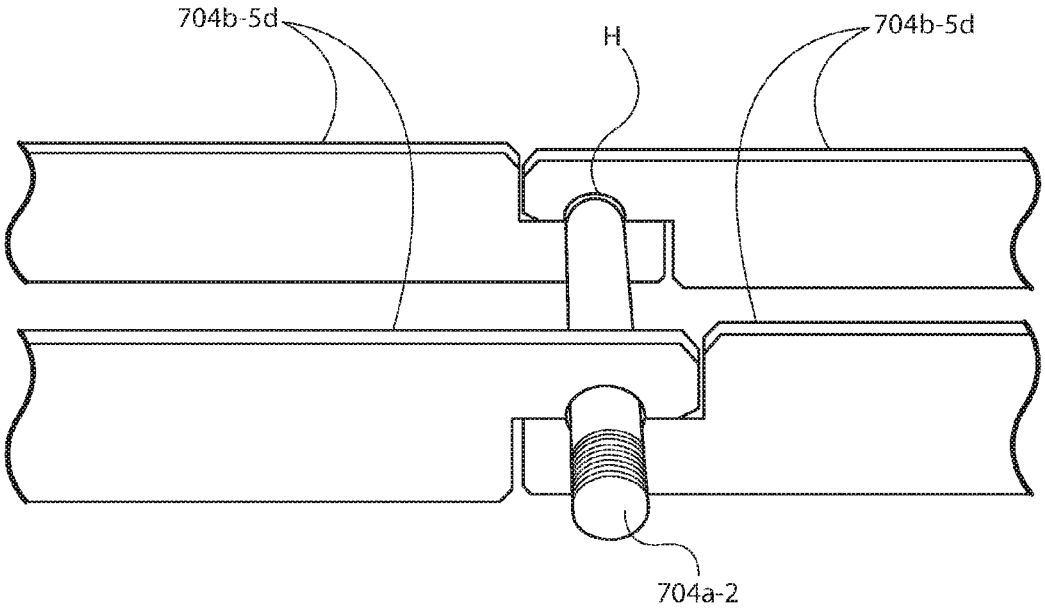

To complete the assembly of the weight holder 700, the second ends 704*b*-5*d* of assembled segments 704*b* and 704*c* (one of which is shown in FIG. 16) are introduced into opposite ends of the body 704*a*-1 of segment 704*a*, as shown by the broken arrows in FIG. 17. In FIG. 17 the second ends 704*b*-5*d* of segments 704*b* and 704*c* arranged facing one another, outside of the body 704*a*-1 of segment 704*a* for purposes of illustration. FIG. 18 shows that the second ends 704*b*-5*d* of the assembled segments 704*b* and 704*c* are brought into engagement with one another, as they would be inside the body 704*a*-1 of segment 704*a* during assembly. As shown in FIG. 18, the semi-circular notches 704*b*-5*e* above and below form a circular opening "H" through which bolt 704*a*-2 may pass. Thus, to fully assemble the weight holder 700, the second ends 704*b*-5*d* of the assembled segments 704*b* and 704*c* are introduced into opposite ends of the body 704*a*-1 of segment 704*a* until they come into engagement, as shown in FIG. 18. Upon such engagement, the opening "H" aligns with holes 704*a*-1*b* in the body 704*a*-1 of segment 704*a*. The lower end 701*a* of post 701 may then be introduced into hole 704*a*-1*a* of body 704*a*-1 and positioned to align its bore 701*b* with opening "H" and holes 704*a*-1*b* so that bolt 704*a*-2 may be inserted through holes 704*a*-1*b*, bore 701*b*, and opening "H", thereby coupling post 701 and segment 704*a* together and coupling segments 704*b* and 704*c* to segment 704*a*. Wingnut 704*a*-3 may be threaded onto bolt 704*a*-2 and hand tightened. The use of wingnuts facilitates assembly and disassembly substantially without tools so that the entire disassembled weight holder 700 may be transported compactly in a gym bag or box.

The disassembly of the weight holder 700 may be performed by reversing all of the assembly steps discussed above. Since all of the wingnuts may be hand tightened, the disassembly steps may be performed without any special tools by simply unthreading all of the wingnuts, removing all of the bolts, and decoupling all of the posts, bodies, and bars from each other as shown in FIG. 14A. Of course, it may not be necessary to completely disassemble the weight holder 700 into as many individual parts shown in FIG. 14A. For example, a user may choose to partially disassemble the holder 700 break into the subassemblies shown in FIG. 17 to reduce the assembly steps before reuse.

The bodies 704*a*-1, 704*b*-1, and 704*c*-1 may be constructed from steel or aluminum tubing. In one embodiment, an aluminum tube having outer dimensions of 3"×2" is used having a ¼ wall thickness. Such a tube has inner dimensions of 1.5"×2.5". In comparison to this example embodiment, a steel tube may substituted for the example aluminum tube. Such a steel tube may have similar outer dimensions to the example tube, but have a ⅛" wall thickness. The bars 704*b*-5 may be formed from 3⁄16 inch thick steel. As discussed above, the bars 704*b*-5 come from opposite ends and meet each other in the same plane by cooperating to form the opening H through which the central bolt 704*a*-2 can pass. When the weight holder 700 is in a fully assembled configuration, the bolt 704*a*-2 simultaneously holds the two sets of bars 704*a*-2 in a vertical orientation between the vertical sides of the tubular bodies 704*a*-1, 704*b*-1, and 704*c*-1 and the posts 701 to 703. It should be noted that the loads on the inserts 704*b*-4, bolts 704*b*-2, and on the end loading posts 702 and 703 themselves are relatively minimal. On the other hand, the loads on the central bolt 704*a*-2, are much larger in comparison, because the central bolt 704*a*-2 transfers most of the weight loaded onto the weight holder 700. However, owing to the construction of the weight holder 700, the loads on the bolt 704*a*-2 are in shear with relatively small moment arm, and therefore, small bending moment. Also, there are virtually no tensile stresses on the bolt, since the wing nut 704*a*-3 is hand tightened (as are all of the wingnuts of the weight holder 700). Thus, the construction of the weight holder 700 provides for a durable and easily assembled and disassembled weight holder that can be easily set up, broken down, and transported without tools.

There have been described and illustrated herein several embodiments of a weightlifting belt and system. While particular embodiments of the invention have been described, it is not intended that the invention be limited thereto, as it is intended that the invention be as broad in scope as the art will allow and that the specification be read likewise. Moreover, while particular configurations have been disclosed in reference to the weightlifting belt and attachments (holders) it will be appreciated that other configurations could be used as well. It will therefore be appreciated by those skilled in the art that yet other modifications could be made to the provided invention without deviating from its spirit and scope as claimed.

What is claimed is:

1. A weightlifting system comprised of:

a weightlifting belt including:

a band of padding configured to be banded about a waist of a user, the band of padding having an interior surface facing the waist of the user and an exterior surface opposite the interior surface; and a chain extending about a length of the exterior surface of the band of padding, such that the chain is coupled to the band of padding at a plurality of spaced locations along the band of padding, wherein the chain is fixed to the band of padding at at least one of the plurality of spaced locations and is moveably coupled to the band of padding at at least one of the plurality of spaced locations, wherein at the plurality of spaced locations the chain is spaced apart from the band of padding; and a weight holder configured to support at least one weight plate having a central opening therethrough, and to couple the at least one weight plate to the weightlifting belt.

2. The weightlifting system according to claim 1, wherein the weight holder includes an elongated base coupled to lower ends of three posts, which are spaced equidistantly from each other, wherein a center one of the three posts has a connector attached to an upper end thereof for connecting the weight holder to the coupler, and wherein each of the three posts is configured to extend through the central opening in the at least one weight plate.

3. The weightlifting system according to claim 2, wherein the elongated base is formed as a modular assembly of three segments, corresponding to each of the three posts, and couplable together and to each of the three posts.

4. The weightlifting system according to claim 3, wherein the three segments are configured for tool-less coupling to one another and to the three posts.

5. The weightlifting system according to claim 2, wherein the connector is a spring catch retained partially inside the upper end, wherein the spring catch includes a hook and spring-loaded gate that interfaces with an end of the hook.

6. The weightlifting system according to claim 2, wherein the weight holder is configured for transport in a gym bag when the weight holder is in a disassembled configuration.

7. The weightlifting system according to claim 1, wherein the chain is coupled to the band of padding with a plurality of fasteners that are spaced along a length of the weightlifting belt.

8. The weightlifting system according to claim 7, wherein the plurality of fasteners are bolts that extend through the chain.

9. The weightlifting system according to claim 8, wherein the band of padding is formed of a compressible material, including rubber.

10. The weightlifting system according to claim 7, wherein the chain includes a plurality of links, wherein the plurality of fasteners extends through corresponding links of the plurality of links, and wherein at least one of the links of the plurality of links is free to rotate and translate with respect to one corresponding fastener of the plurality of fasteners.

11. The weightlifting system according to claim 1, further comprising a coupler for coupling ends of the chain together.

12. The weightlifting system according to claim 11, wherein the weight holder includes an upper hook and a lower hook joined to the upper hook, the upper hook configured to connect to the coupler and the lower hook configured to pass through the central opening in the at least one weight plate.

13. The weightlifting system according to claim 12, wherein the lower hook has a free end and a closed end, wherein the free end is configured to pass through the central opening in the at least one weight plate, and wherein the lower hook is configured to urge the at least one weight plate towards the closed end.

14. The weightlifting system according to claim 12, wherein the upper hook and the lower hook are oriented perpendicular to each other.

15. The weightlifting system according to claim 1, wherein a center of the chain is fixed to a center of the band of padding.

16. The weightlifting system according to claim 15, wherein the chain is configured to extend about the outer surface of the band of padding when the band of padding and the chain are banded about the waist of the user.

17. The weightlifting system according to claim 16, wherein the chain is radially spaced with respect to the outer surface of the band of padding.

18. The weightlifting system according to claim 1, wherein the weight holder includes a post, a base attached to a lower end of the post, and a connector attached to an upper end of the post, the post being configured to extend through the central opening in the at least one weight plate, and wherein the connector is configured to removably connect to a coupler for coupling ends of the chain together.

19. The weightlifting system according to claim 18, wherein the post has a diameter less than the central opening of the at least one weight plate and the base has a diameter larger than the central opening of the at least one weight plate.

20. The weightlifting system according to claim 18, wherein the connector is a spring catch retained partially inside the upper end, wherein the spring catch includes a hook and spring-loaded gate that interfaces with an end of the hook.

21. The weightlifting system according to claim 18, wherein the post is extendable.

22. The weightlifting system according to claim 1, further comprising a coupler for coupling ends of the chain together to band the weightlifting belt about the waist of the user.

23. The weightlifting system according to claim 1, wherein the chain is continuous.

24. The weightlifting system according to claim 1, wherein the chain has a length that is at least as long as the length of the band of padding.

25. The weightlifting system according to claim 1, wherein the chain includes links having a ninety-degree twist.

26. The weightlifting system according to claim 1, wherein a load transferred to the chain caused by the user lifting the load is isolated between the chain and the band of padding of the weightlifting belt.

27. A weightlifting system comprised of:

a weightlifting belt including:

a band of padding configured to be banded about a waist of a user, the band of padding having an interior surface facing the waist of the user and an exterior surface opposite the interior surface; and a chain extending about a length of the exterior surface of the band of padding, the chain being coupled to the band of padding at a plurality of spaced locations along a length of the band of padding; and a weight holder configured to support at least one weight plate having a central opening therethrough, and to couple the at least one weight plate to the weightlifting belt, wherein the weight holder includes a post, a base attached to a lower end of the post, and a connector attached to an upper end of the post, the post being configured to extend through the central opening in the at least one weight plate, wherein the connector is configured to removably connect to the coupler, wherein the connector is a spring catch retained partially inside the upper end of the post, wherein the spring catch includes a hook and spring-loaded gate that interfaces with an end of the hook, and wherein the hook and spring-loaded gate are separately rotatable relative to the post.

* * * * *